US009580243B2

(12) United States Patent
Reeb

(10) Patent No.: US 9,580,243 B2
(45) Date of Patent: Feb. 28, 2017

(54) LOCKING DEVICE FOR WASTE CONTAINER

(71) Applicant: SERIO-US INDUSTRIES, INC., Baltimore, MD (US)

(72) Inventor: David L. Reeb, Sykesville, MD (US)

(73) Assignee: Serio-US Industries, Inc., Baltimore, MD (US)

( * ) Notice: Subject to any disclaimer, the term of this patent is extended or adjusted under 35 U.S.C. 154(b) by 349 days.

(21) Appl. No.: 14/267,613

(22) Filed: May 1, 2014

(65) Prior Publication Data

US 2015/0314957 A1 Nov. 5, 2015

(51) Int. Cl.

| | |
|---|---|
| ***E05C 3/12*** | (2006.01) |
| ***B65F 1/14*** | (2006.01) |
| ***B65F 1/12*** | (2006.01) |
| *B65F 1/16* | (2006.01) |

(52) U.S. Cl.

CPC ..... *B65F 1/1615* (2013.01); *B65F 1/122* (2013.01); *B65F 1/1646* (2013.01); *B65F 2001/1669* (2013.01)

(58) Field of Classification Search

CPC ..... E05B 15/0093; E05B 65/5292; E05B 2047/0075; B65F 1/1615; B65F 1/122; E05C 3/12

USPC ..... 292/230, 231, 232, 233, 236, 239, 252; 220/315, 324

See application file for complete search history.

(56) References Cited

U.S. PATENT DOCUMENTS

| | | | | |
|---|---|---|---|---|
| 4,844,113 | A | 7/1989 | Jones | |
| 5,094,358 | A | 3/1992 | Serio, Sr. | |
| 5,149,153 | A | 9/1992 | Drewry et al. | |
| 5,152,562 | A | 10/1992 | Stevenson et al. | |
| 5,201,434 | A | 4/1993 | DeVivo et al. | |
| 5,213,382 | A | 5/1993 | Dawdy et al. | |
| 5,224,743 | A | 7/1993 | Dawdy et al. | |
| 5,224,744 | A | 7/1993 | Michelutti | |
| 5,388,876 | A | 2/1995 | Saincome | |
| 5,415,314 | A | 5/1995 | McCollum | |
| 5,419,598 | A * | 5/1995 | Kreitzer | B65F 1/1615 292/205 |
| 5,474,341 | A | 12/1995 | Putman et al. | |
| 5,490,606 | A | 2/1996 | Lombardo | |
| 5,599,050 | A | 2/1997 | Tinsley | |
| 5,662,364 | A * | 9/1997 | Reeb | B65F 1/1615 292/230 |

(Continued)

*Primary Examiner* — King M Chu
(74) *Attorney, Agent, or Firm* — Berenato & White, LLC

(57) ABSTRACT

A locking device for a container having a hinged lid, comprises a base unit adapted to be fixed to the container and a pivotable unit mounted to the base unit and pivotally movable between open and closed positions. The base unit includes a locking mechanism comprising a casing, a rotatable shaft, a blocking member fixed to the shaft and disposed in the casing, and a rolling member. The pivotable unit is mounted to the shaft of the base unit. The rolling member is provided to move within the casing between a blocking position wherein the rolling member blocks movement of the pivotable unit relative to the casing to prevent unauthorized opening of the lid, and a release position wherein the rolling member moves away from the blocking member to permit the movement of the blocking member relative to the casing thereby permitting opening of the lid.

32 Claims, 31 Drawing Sheets

(56) References Cited

U.S. PATENT DOCUMENTS

| | | | | | |
|---|---|---|---|---|---|
| 5,683,126 | A * | 11/1997 | De Vivo | B65F 1/1615 | 220/315 |
| 5,697,655 | A | 12/1997 | Strong | | |
| 5,738,395 | A * | 4/1998 | Probst | B65F 1/1615 | 220/315 |
| 5,997,052 | A * | 12/1999 | Reeb | B65F 1/1615 | 292/148 |
| 6,290,093 | B1 | 9/2001 | Obriot et al. | | |
| 6,382,688 | B1 | 5/2002 | Agostini | | |
| 6,550,827 | B1 | 4/2003 | Tsujino | | |
| 6,666,485 | B1 | 12/2003 | Moret | | |
| 6,733,053 | B2 | 5/2004 | Hodge et al. | | |
| 6,802,550 | B1 | 10/2004 | Griggs, Jr. et al. | | |
| 6,808,080 | B2 | 10/2004 | Spiers et al. | | |
| 6,851,288 | B2 | 2/2005 | Howes | | |
| 7,234,327 | B2 | 6/2007 | Howes | | |
| 7,506,902 | B2 | 3/2009 | Sheng et al. | | |
| 7,806,447 | B2 * | 10/2010 | Reeb | B65F 1/1615 | 220/315 |
| 8,313,126 | B2 * | 11/2012 | Ferkovich | B65F 1/1615 | 292/11 |
| 8,550,282 | B1 * | 10/2013 | Libhart | B65F 1/1615 | 220/234 |
| 8,960,735 | B2 * | 2/2015 | Michael | E05C 3/24 | 292/100 |
| 2009/0066092 | A1 * | 3/2009 | Reeb | B65F 1/1615 | 292/184 |

* cited by examiner

LOCKING DEVICE FOR WASTE CONTAINER

BACKGROUND OF THE INVENTION

1. Field of the Invention

The present invention generally relates to containers and, more particularly, relates to a gravity operated safety locking device for a container.

2. Description of the Related Art

As is well known, waste containers, such as refuse dumpsters for use in residential and industrial applications, typically include a container supported on a base structure. With the advent of mechanized trash removal, there have been created a number of large sized trash bins or dumpster containers. These containers usually comprise a block-shaped or pyramid-shaped container with a hinged lid attached to one side thereof. The container further includes attachments for accommodating various forked lifting mechanisms of the trash removal vehicle. The containers are lifted by the lifting mechanism of the trash removal vehicle and pivoted in some fashion so that the hinged top of the container opens and the trash contained therein is emptied into the vehicle. The container is then returned to a position on the ground, and the hinged lid closes on top of the container. Many of these large trash receptacles are rented from a trash removal service. These receptacles are not provided free of charge, and consequently their frequent emptying and service can become a considerable expense. This expense is increased when unauthorized users of the receptacle freely deposit trash therein. This unauthorized use necessitates a more frequent emptying of the container, and of course the unauthorized user does not contribute to the increased expense.

In order to reduce the added expense that comes from unauthorized use, the dumpsters must be locked. While conventional chains and padlocks reduce unauthorized dumpster use, they also add to operating expenses because the driver of the truck emptying the dumpster must get out of the truck to unlock the padlock on the dumpster. In the early 1990's, companies began the development and marketing of dumpster locking mechanisms that open automatically when the dumpster is lifted and inverted to dump the trash into the truck. With such as automatic lock, the driver is not required to leave the truck which saves the trash company hundreds of dollars each year.

Conventional automatic locks are typically bulky, expensive and difficult to mount to multiple containers. Since container come in a variety of shapes and sizes, it is important that the locking device be sized and shaped to be retrofit onto a variety of existing containers. Moreover, the locking device must be able to withstand the rigors of everyday, outdoor use in the waste environment.

The need therefore exists for an automatic locking device that improves upon prior automatic locking devices and solves the problems inherent in known automatic locking devices.

SUMMARY OF THE INVENTION

According to a first aspect of the invention, there is provided a locking device for a container having a hinged lid. The locking device comprises a base unit adapted to be fixed to the container, and a pivotable unit mounted to the base unit and pivotally movable between an open position allowing opening of the hinged lid and a closed position preventing the opening of the hinged lid. The base unit includes a locking mechanism comprising a casing, a rotatable shaft extending through the casing, a blocking member non-movably secured to the rotatable shaft and disposed in the casing, and a rolling member movably disposed within the casing. The pivotable unit is mounted to the rotatable shaft of the base unit. The rolling member is provided to move within the casing between a blocking position wherein the rolling member blocks rotational movement of the pivotable unit relative to the casing to prevent unauthorized opening of the hinged lid, and a release position wherein the rolling member moves away from the blocking member to permit the rotational movement of the blocking member relative to the casing thereby permitting the relative movement between the pivotable unit and the base unit to allow opening of the hinged lid.

According to a second aspect of the present invention, there is provided a container moveable by a dumping vehicle between an upright position and a tilted position sufficient to enable at least some of the contents of the container to be dumped therefrom. The container comprises a container body, at least one hinged lid pivotally mounted to the container body, and a locking device. The at least one hinged lid is moveable between a closed position when the container is in the upright position and an open position when the container is in the tilted position. The locking device comprises a base unit adapted to be fixed to the container, and a pivotable unit mounted to the base unit and pivotally movable between an open position allowing opening of the hinged lid and a closed position preventing the opening of the hinged lid. The base unit includes a locking mechanism comprising a casing, a rotatable shaft extending through the casing, a blocking member non-movably secured to the rotatable shaft and disposed in the casing, and a rolling member movably disposed within the casing. The pivotable unit is mounted to the rotatable shaft of the base unit. The rolling member is provided to move within the casing between a blocking position wherein the rolling member blocks rotational movement of the pivotable unit relative to the casing to prevent unauthorized opening of the hinged lid, and a release position wherein the rolling member moves away from the blocking member to permit the rotational movement of the blocking member relative to the casing thereby permitting the relative movement between the pivotable unit and the base unit to allow opening of the hinged lid.

Other aspects of the invention, including apparatus, devices, systems, converters, processes, and the like which constitute part of the invention, will become more apparent upon reading the following detailed description of the exemplary embodiments.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. The objects and advantages of the invention will become apparent from a study of the following specification when viewed in light of the accompanying drawings, in which like elements are given the same or analogous reference numerals and wherein:

FIG. 28 is a side view of the locking device according to the second exemplary embodiment of the present invention in the tilted position with a locking bar in the open position, showing the locking mechanism in the release position in the casing without the rear cover plate and the padlock;

DETAILED DESCRIPTION OF PREFERRED EMBODIMENTS

Figure 1:
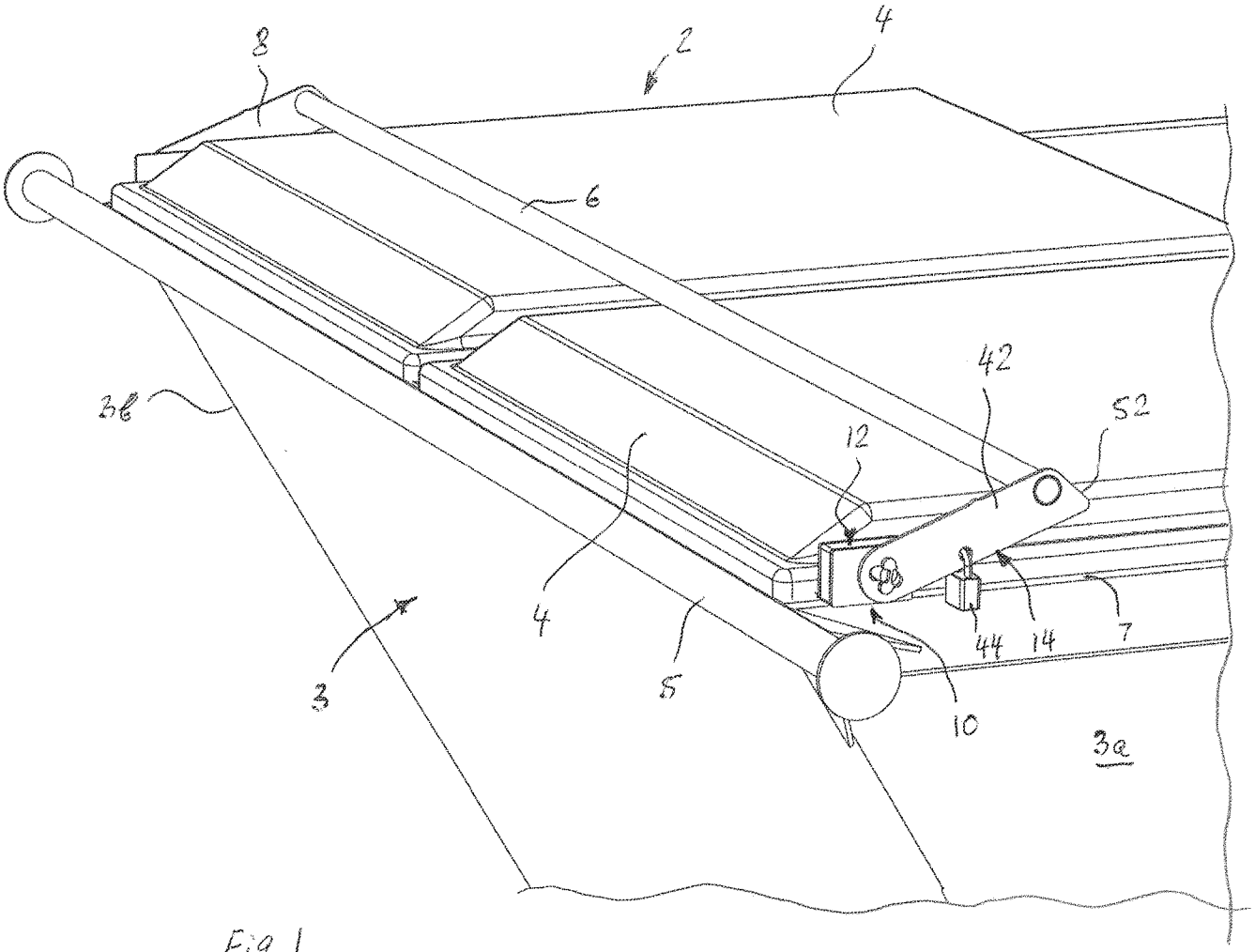
FIG. 1 is a perspective view of a waste container in an upright position with a locking device according to a first exemplary embodiment of the present invention shown in a closed position with a padlock.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "up," "down," "upper", "lower", "right", "left", "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. Additionally, the word "a" and "an" as used in the claims means "at least one" and the word "two" as used in the claims means "at least two".

FIGS. 1-4 of the drawings illustrates a waste or storage container 2 according to a first exemplary embodiment of the present invention, such as a trash collector or dumpster, including a container body 3, at least one hinged lid 4 pivotally mounted thereto, a safety locking device 10 and a locking bar 6 extending substantially across the length of the waste container 2, as illustrated in FIGS. 1-4. The waste container 2 further includes a trunnion bar 5 non-movably secured (i.e., fixed) to the container body 3, such as by welding, so as to extend substantially parallel to the locking bar 6. The container body 3 is formed with a channel 7 defined as a top rim of the container body 3. The locking device 10 is provided for locking and unlocking the hinged lids 4 of the waste container 2 to prevent the inadvertent dumping of its content. The locking bar 6 extends between the locking device 10 at one end and a pivoting bar 8 at the other end thereof. The locking device 10 is mounted to a right side wall 3*a* of the container body 3 (herein defined as a lock side of the container body 3), while the pivoting bar 8 is pivotally mounted to a left side wall 3*b* thereof (herein defined as a dummy side of the container body 3). Specifically, the locking device 10 is mounted to the channel 7 on the right side wall 3*a* of the container body 3. Alternatively, the locking device 10 may be mounted to the right side wall 3*a* of the container body 3.

The waste container 2, as illustrated in FIGS. 1-4, is generally an industrial-type dumpster used for retaining, storing, and eventually disposing of refuse (waste), such as glass fragments produced during the manufacture of automotive glass. The container 2 may be tilted or otherwise pivoted from an upright (or on-the-ground) position (wherein the waste container 2 is sitting generally horizontally on the ground) (shown in FIG. 1) to a tilted or dumping position (shown in FIG. 2).

Figure 2:
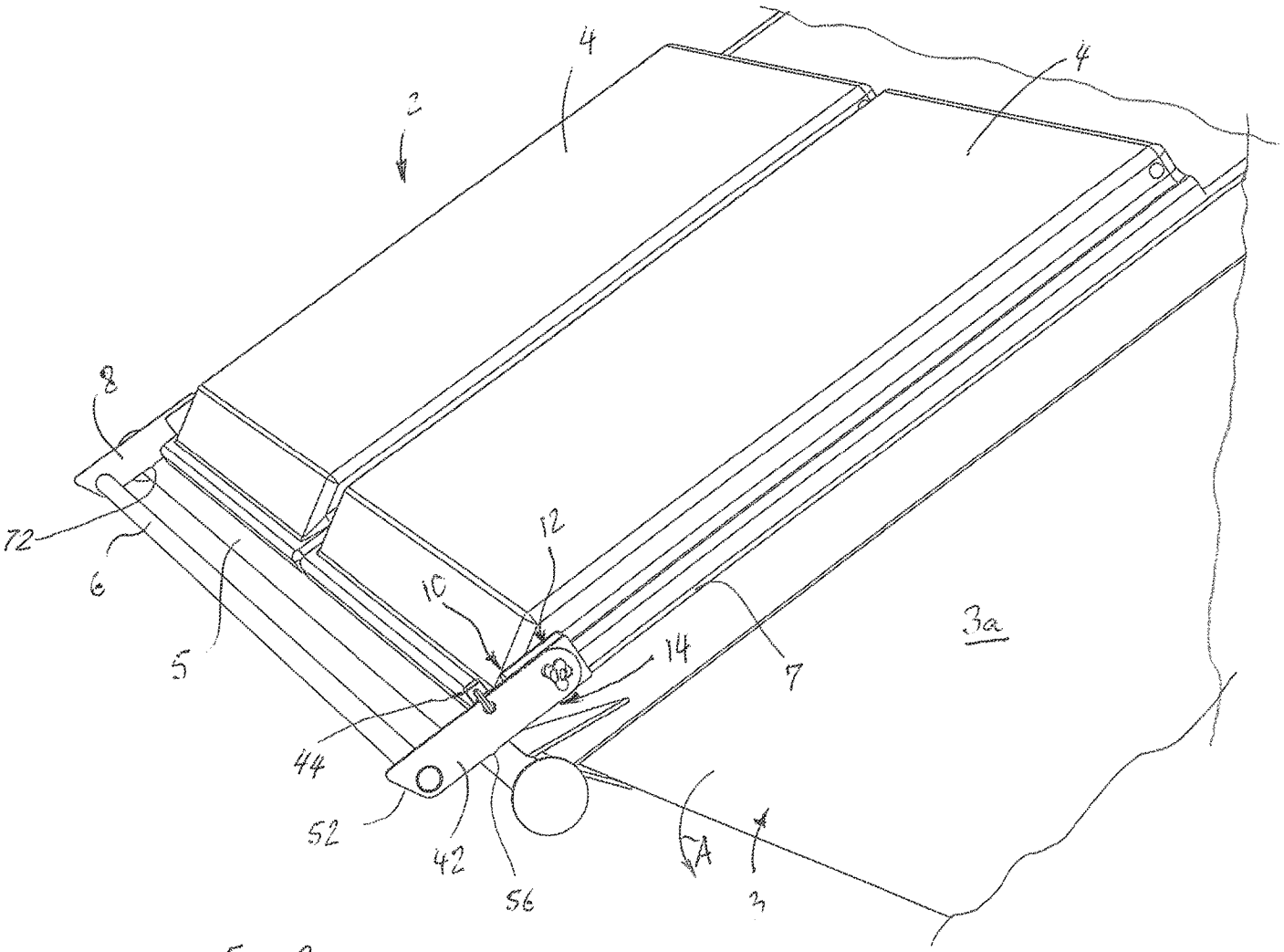
FIG. 2 is a perspective view of the waste container of FIG. 1 in a tilted position with the locking device according to the first exemplary embodiment of the present invention shown in an open position with the padlock.
Figure 3:
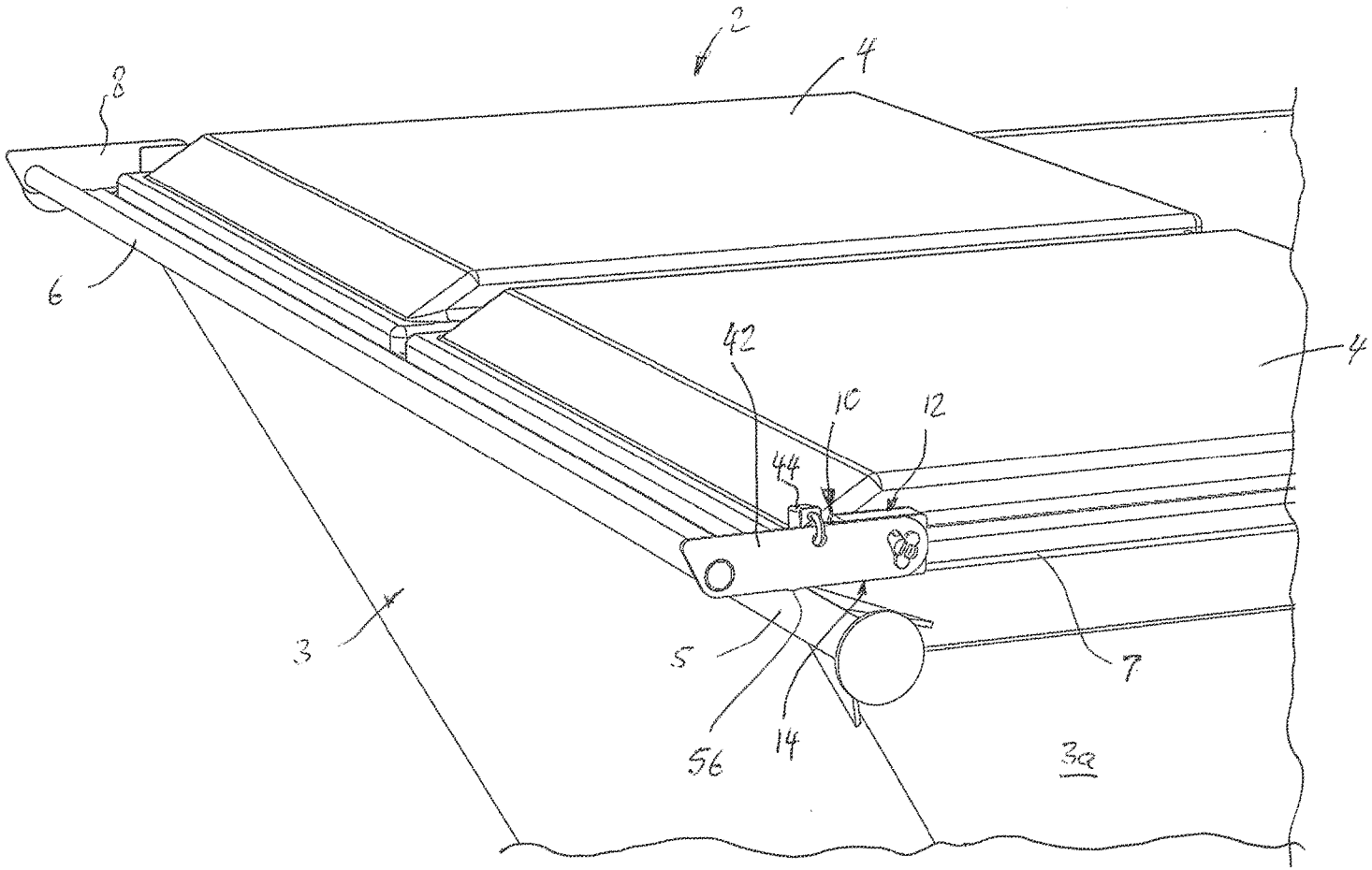
FIG. 3 is a perspective view of the waste container of FIG. 1 in the upright position with the locking device shown in the open position and with the padlock.
Figure 4:
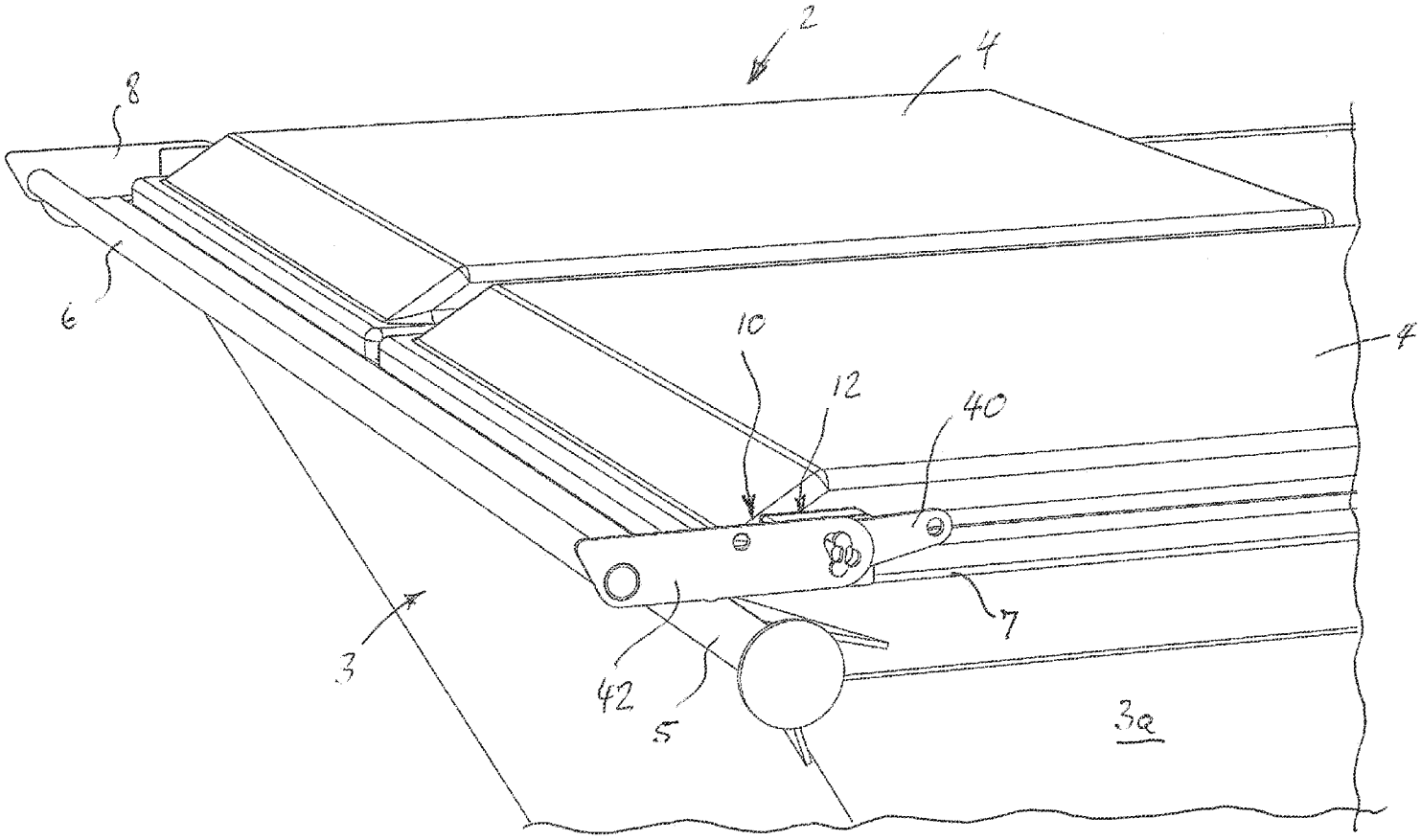
FIG. 4 is a perspective view of the waste container of FIG. 1 in the upright position with the locking device shown in the open position without the padlock and with an outer plate of a pivotable unit separated from an inner plate.

The locking device 10 according to a first exemplary embodiment of the present invention, as illustrated in detail in FIGS. 5-13, comprises a base unit 12 fixed to the right side wall 3*a* of the waste container 2, and an elongated pivotable unit 14 pivotally mounted to the base unit 12 for pivotable movement relative to the base unit 12 about a pivot axis 15. The locking bar 6 is secured to the pivotable unit 14 at a distal end thereof so as to extend substantially across the length of the waste container 2, as illustrated in FIGS. 1-4. The pivotable unit 14, the pivoting bar 8 and the locking bar 6 movable therewith are provided to translate from a closed position (shown in FIG. 1) wherein the locking bar 6 extends over the hinged lids 4 of the waste container 2 so as to prevent opening of the waste container 2, as illustrated in FIG. 1, to an open position (shown in FIGS. 2-4) wherein the locking bar 6 is horizontally spaced away from the hinged lids 4 of the waste container 2 so as to allow the opening of the hinged lids 4 of the waste container 2, as illustrated in FIGS. 2-4.

The base unit 12, as illustrated in detail in FIGS. 5-13, comprises a hollow casing 16 and an automatic, pivoting, gravity operated locking mechanism 18 disposed in the casing 16. The casing 16 includes opposite top and bottom walls $\mathbf{20}_T$ and $\mathbf{20}_B$, respectively, opposite side walls 23, a front cover $\mathbf{22}_F$ and a rear cover $\mathbf{22}_R$ connected to each other so as to form the hollow casing 16 defining a cavity 17 therewithin. The base unit 12 further comprises a mounting plate 24 non-movably attached (i.e., fixed) to the casing 16, such as by welding. The locking device 10 is mounted to the container body 3 by fixing (such as by welding) the mounting plate 24 to the channel 7 on the right side wall 3*a* of the container body 3. Thus, the locking mechanism 18 is adapted to rotate (pivot) with the waste container 2. Alternatively, the casing 16 of the locking device 10 may be mounted to the right side wall 3*a* of the container body 3.

Figure 5:
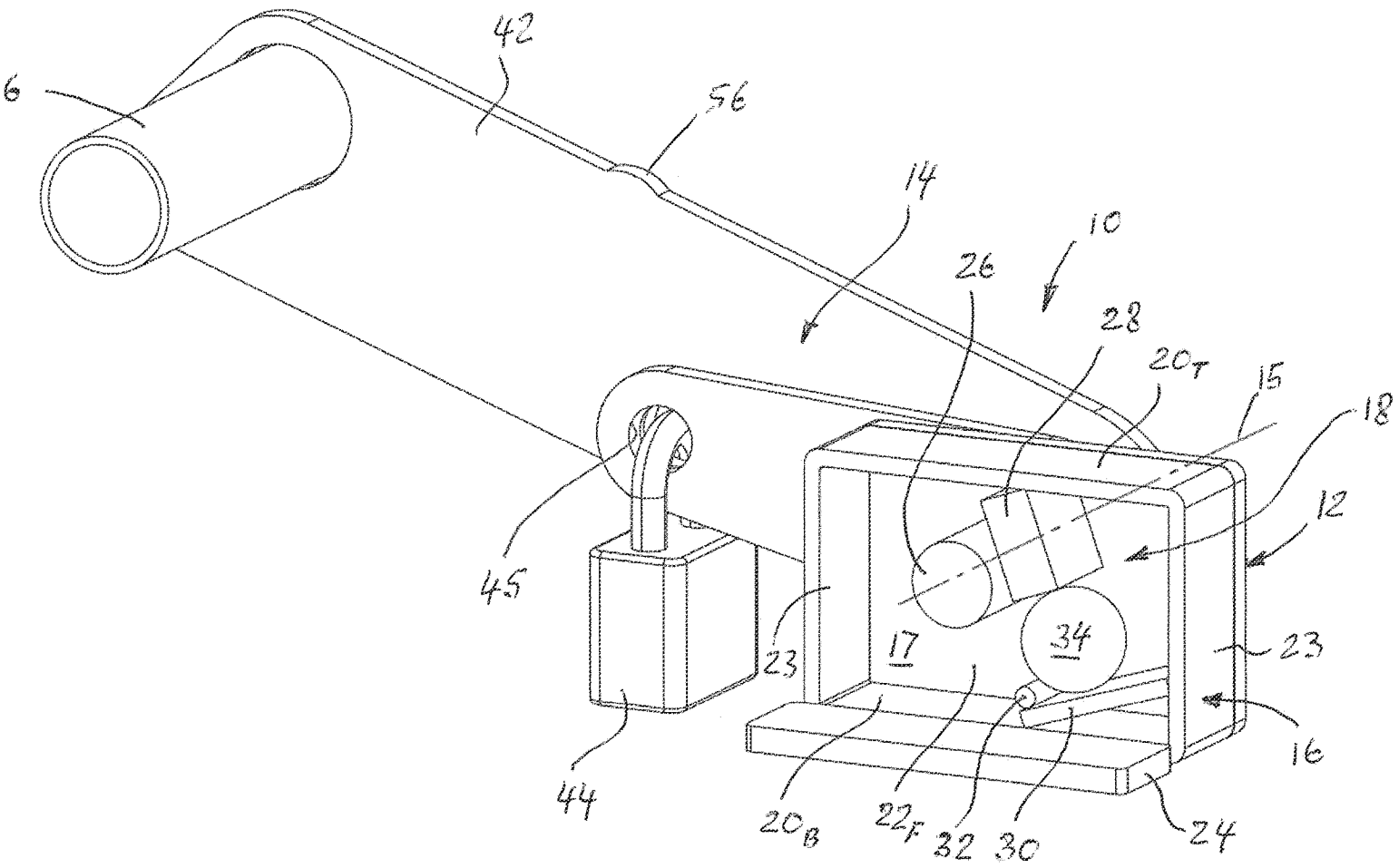
FIG. 5 is a perspective view of the locking device according to the exemplary embodiment of the present invention showing a locking mechanism in a blocking position, in a casing without a rear cover plate.
Figure 6:
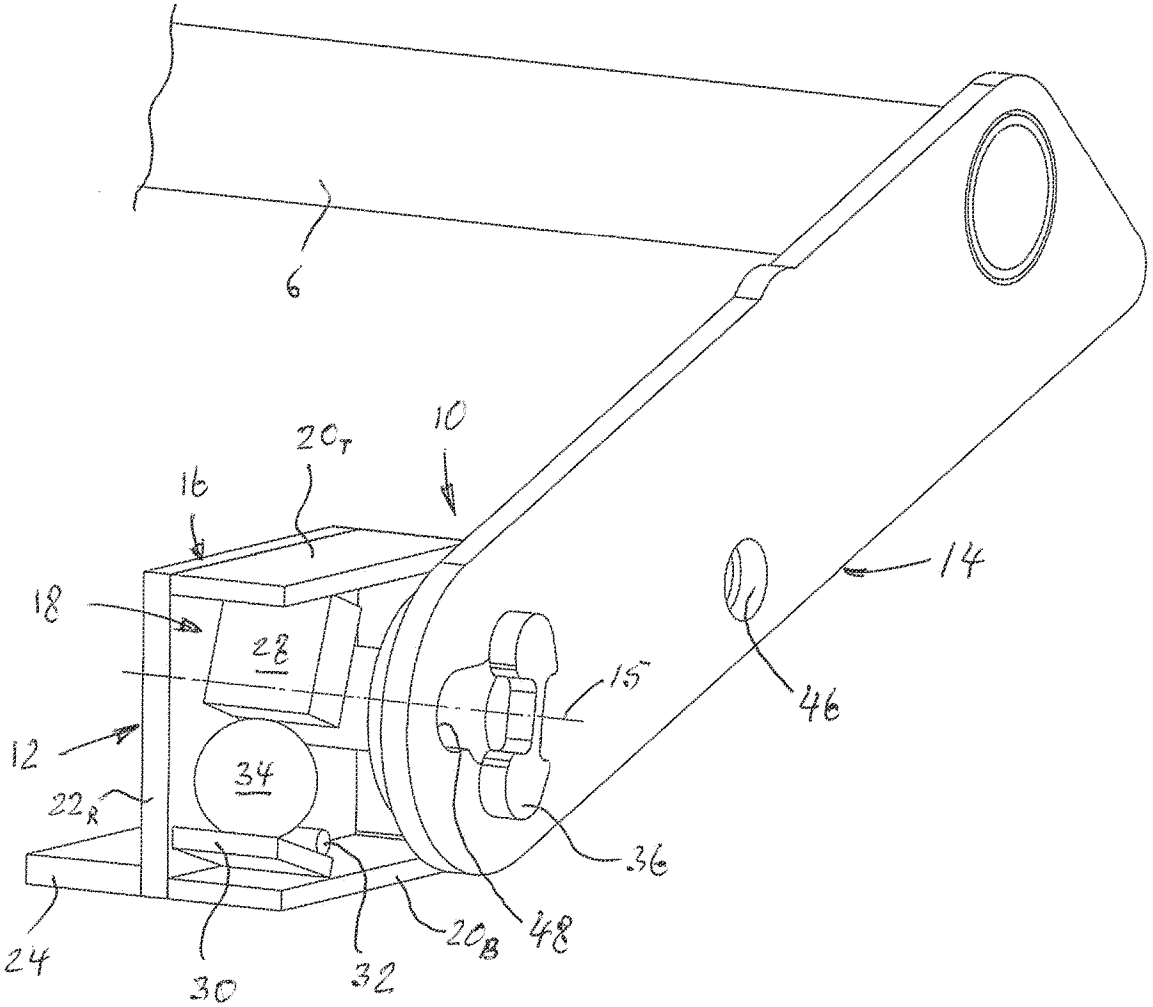
FIG. 6 is a perspective view of the locking device according to the exemplary embodiment of the present invention showing the locking mechanism in the blocking position, in the casing without a front cover plate.
Figure 7:
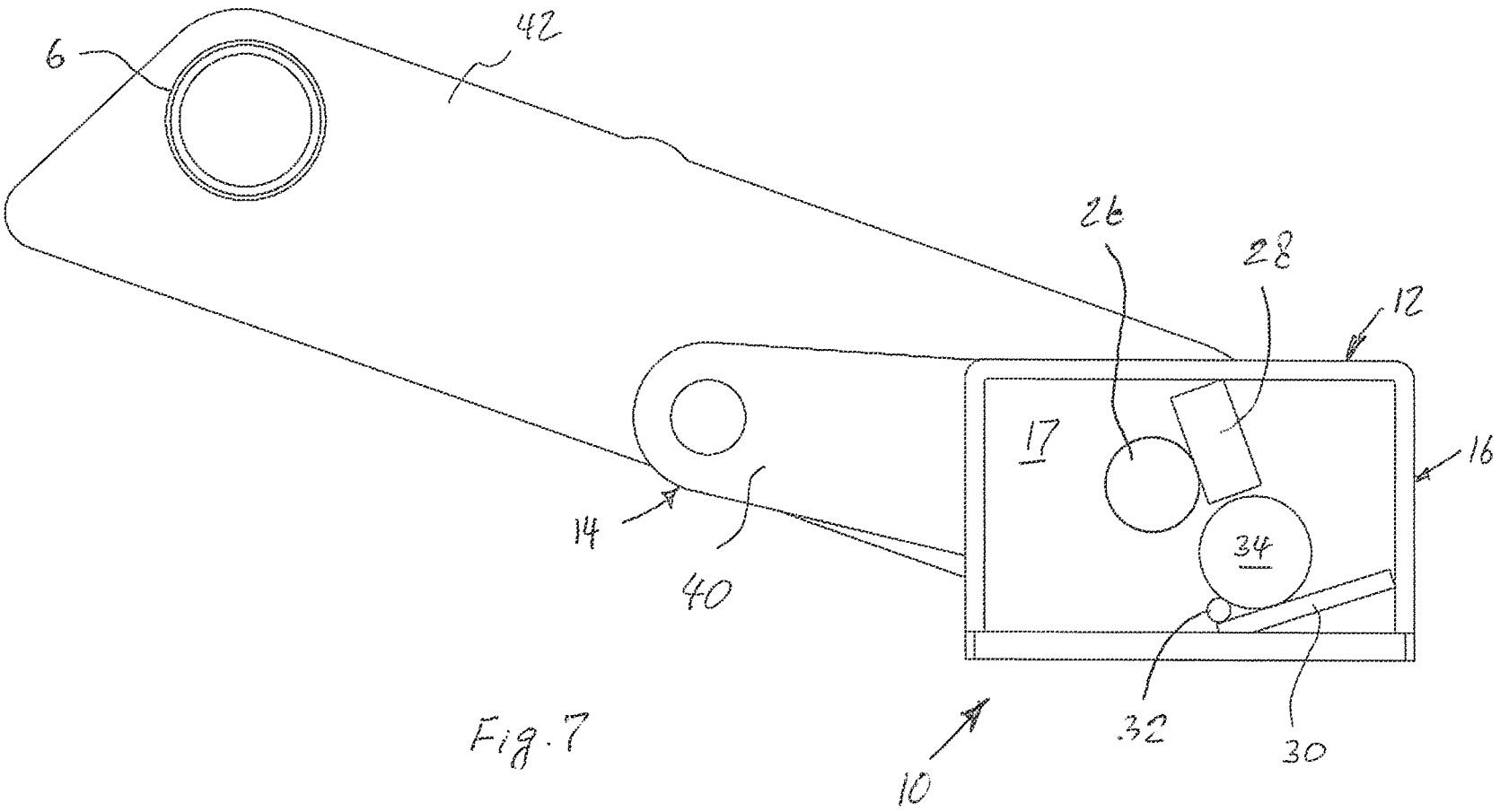
FIG. 7 is a side view of the locking device according to the first exemplary embodiment of the present invention in the closed position, showing the locking mechanism in the blocking position in the casing without the rear cover plate and the padlock.
Figure 8:
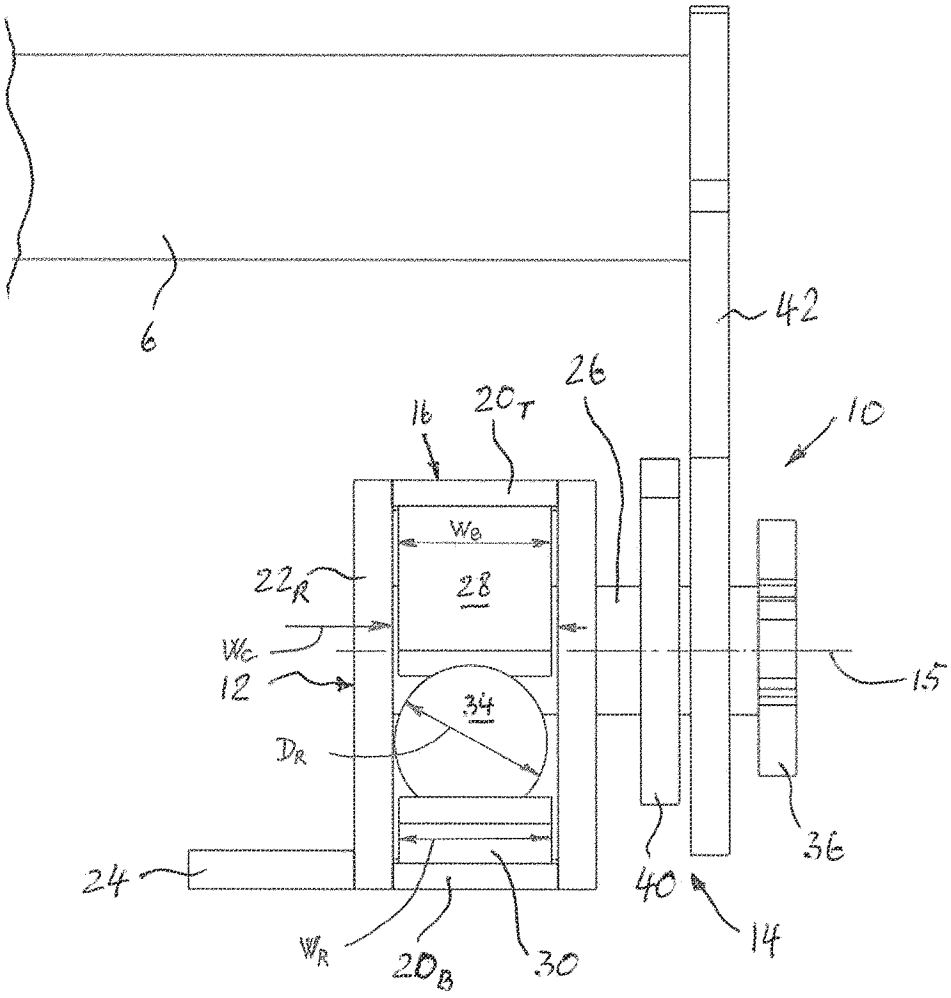
FIG. 8 is a front view of the locking device according to the first exemplary embodiment of the present invention in the closed position, showing the locking mechanism in the blocking position, in the casing without a side plate.
Figure 9:
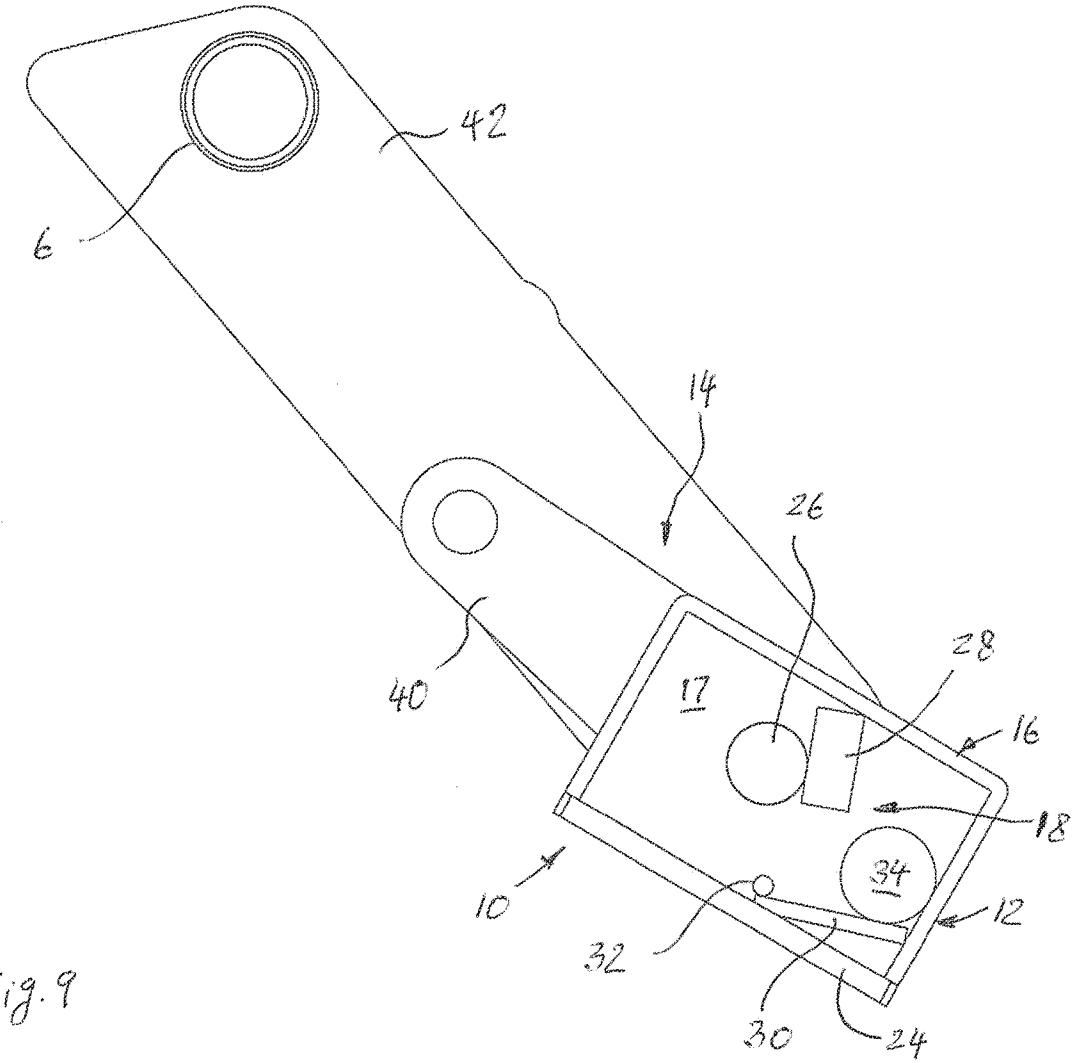
FIG. 9 is a side view of the locking device according to the first exemplary embodiment of the present invention in a tilted position, showing the locking mechanism in a release position in the casing without the rear cover plate and the padlock.
Figure 10:
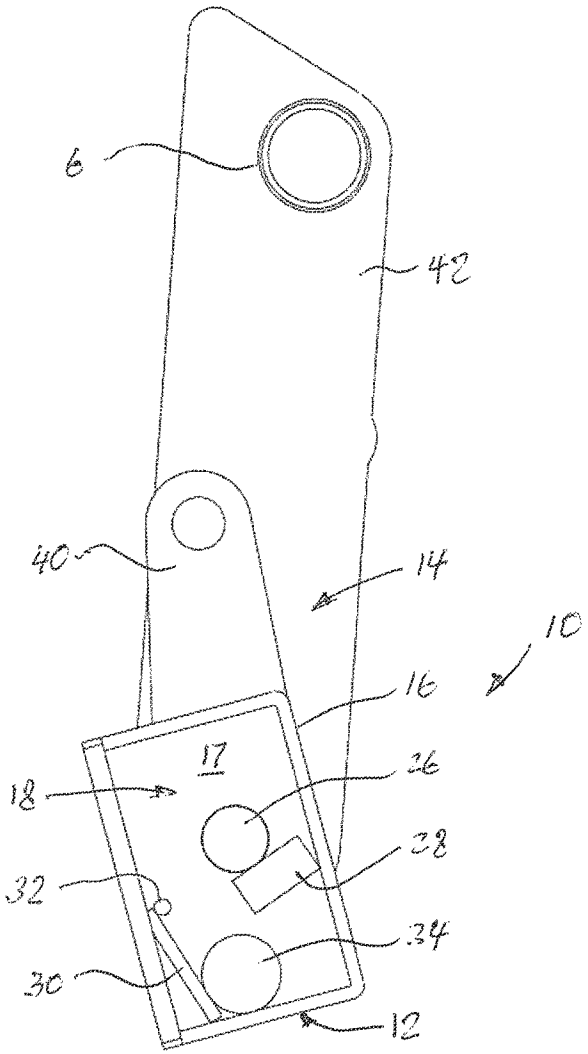
FIG. 10 is another side view of the locking device according to the first exemplary embodiment of the present invention in the tilted position, showing the locking mechanism in the release position in the casing without the rear cover plate and the padlock.

The locking mechanism 18 comprises a rotatable shaft 26 extending through the front cover $\mathbf{22}_F$ of the casing 16, a blocking member 28 non-movably secured (i.e., fixed) to an outer peripheral surface of the shaft 26 such as by welding, a slanted ramp 30, a stop member 32 fixed to a proximal end of the slanted ramp 30 adjacent to the bottom wall $\mathbf{20}_B$ of the casing 16, and a rolling member 34 movably disposed within the casing 16 between the stop member 32 and the side wall 23 of the casing 16. In the first exemplary embodiment of the present invention the rolling member 34 is in the form of a spherical ball as best illustrated in FIGS. 5, 6 and 8. Alternatively, the rolling member 34 is in the form of a cylindrical disc. The slanted ramp 30 is fixed to the casing 16 so as to be oriented at an oblique angle (i.e., not 0°, 90° or 180°) relative to the bottom wall $\mathbf{20}_B$ of the casing 16. The slanted ramp 30 extends between the bottom wall $\mathbf{20}_B$ and the side wall of the casing 16 so that the proximal end of the slanted ramp 30 is fixed to the bottom wall $\mathbf{20}_B$ of the casing 16, while a distal end of the slanted ramp 30 is fixed to the side wall 23 of the casing 16. The stop member 32 is provided to retain the rolling member 34 on the slanted ramp 30 so that the rolling member 34 is movable on the slanted ramp 30 between the stop member 32 and the side wall 23 of the casing 16. As best shown in FIG. 8, a width $W_B$ of the blocking member 28 in the direction of the axis 15 is substantially the same as a width $W_R$ of the slanted ramp 30 and the stop member 32 and the diameter $D_R$ of the spherical ball 34. As further illustrated in FIG. 8, a width $W_c$ of the cavity 17 within the casing 16 in the direction of the axis 15 is slightly larger than the width $W_B$ of the blocking member 28, the width $W_R$ of the slanted ramp 30 and the stop member 32, and the diameter $D_R$ of the spherical ball 34.

Figure 14:
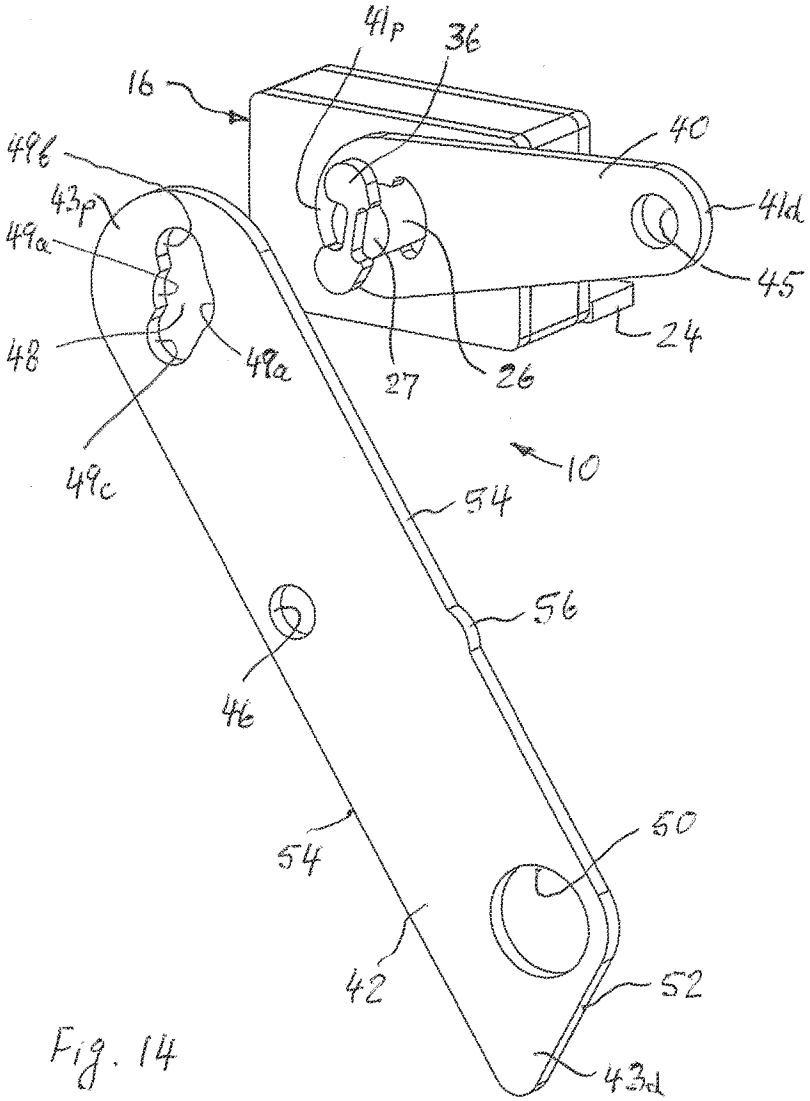
FIG. 14 is a perspective view of the locking device according to the first exemplary embodiment of the present invention with the inner plate mounted to the locking mechanism and the outer plate separated from the locking mechanism.
Figure 15:
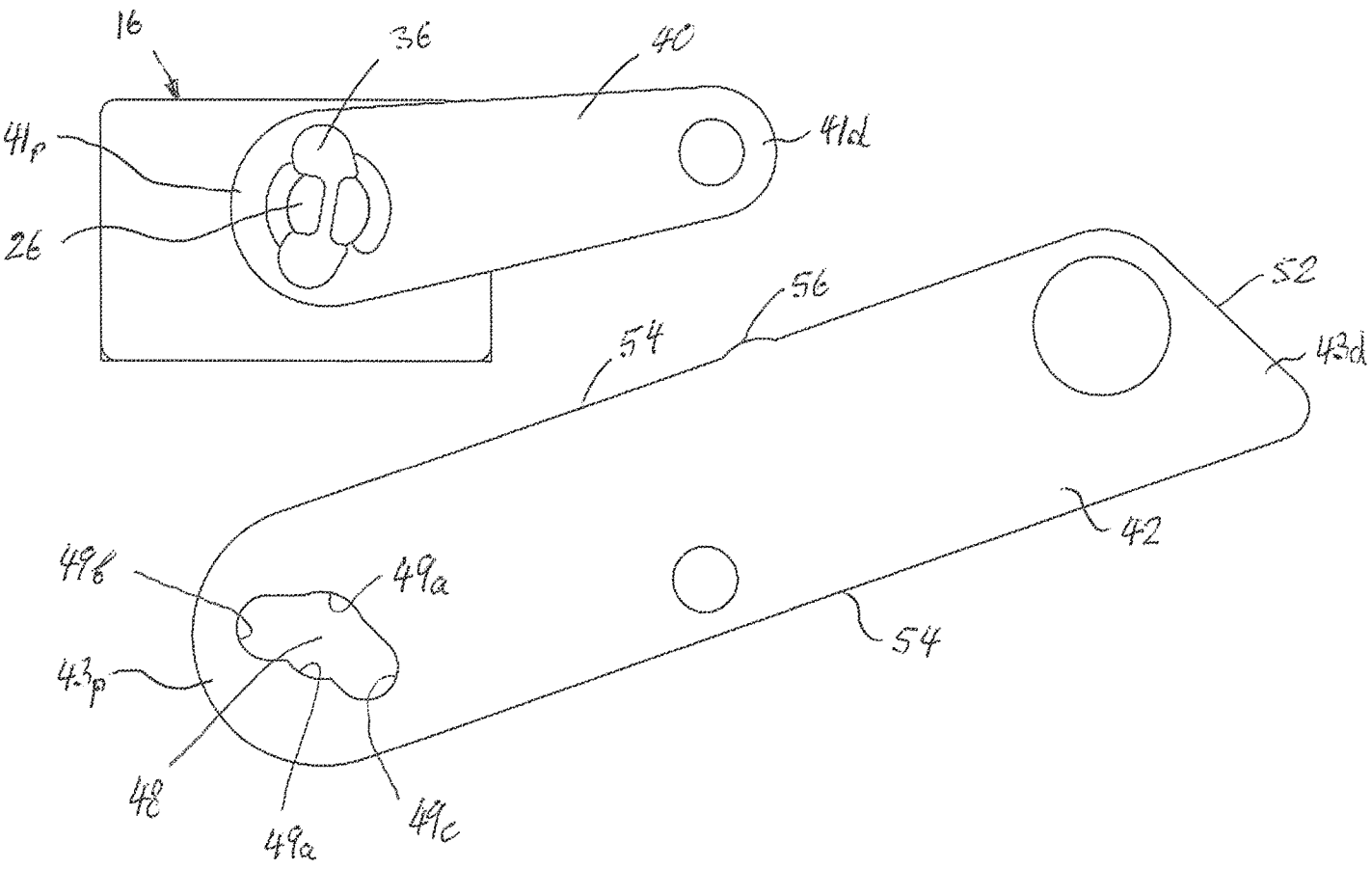
FIG. 15 is a side view of the locking device according to the first exemplary embodiment of the present invention with the inner plate mounted to the locking mechanism and the outer plate separated from the locking mechanism.

As further illustrated in FIGS. 5-13, the pivotable unit 14 comprises an inner plate 40 non-movably attached (i.e., fixed) to the rotatable shaft 26 of the locking mechanism 18, and a outer plate 42 rotatably mounted to the rotatable shaft 26 and pivotally movable relative to the inner plate 40. Moreover, the inner plate 40 is oriented substantially parallel to the outer plate 42. As best shown in FIGS. 14 and 15, the inner plate 40 has a proximal end 41*p* and a distal end 41*d*. As further illustrated, the inner plate 40 is non-movably fixed to the rotatable shaft 26 adjacent to the proximal end 41*p* of the inner plate 40.

In order to prevent rotation of the outer plate 42 relative to the inner plate 40 by an unauthorized person, a lock device, such as a padlock 44 (shown in FIGS. 1-3 and 5), may be used. Specifically, the padlock 44 locks together the outer plate 42 and the inner plate 40 by extending through an aperture 45 through the inner plate 40 (best shown in FIGS. 4-8 and 15) and an aperture 46 through the outer plate 42 (shown in FIGS. 5, 8, 9-11, and 15) and complementary to the aperture 45 through the inner plate 40. It will be appreciated that any type of a lock device which locks the outer plate 42 to the inner plate 40 may be employed in order to allow only an authorized person to unlock the outer plate 42. Thus, the outer plate 42 is locked and unlocked by the padlock 44 being placed through the holes 46 and 45 in the outer plate 42 and the inner plate 40, respectively. As further illustrated in FIGS. 4 and 13, when the padlock 44 is removed from the pivotable unit 14 and the outer plate 42 unlocked from the inner plate 40, the outer plate 42, thus the locking bar 6, can be rotated to the open position thereof even if the waste container 2 is in the upright position (as shown in FIG. 4).

A distal end 27 of the rotatable shaft 26, disposed outside the casing 16, is provided with a slide plate key 36. As best illustrated in FIGS. 5, 6 and 8, the slide plate key 36 has a non-circular shape, extends in a plane substantially perpendicular to the axis 15, and is axially spaced from the casing 16. In the first exemplary embodiment of the present invention, the slide plate key 36 is non-movably attached (i.e., fixed) to the distal end 27 of the rotatable shaft 26 after the inner plate 40 is fixed to the rotatable shaft 26.

As best illustrated in FIGS. 14 and 15, the outer plate 42 has an opening 48 therethrough provided at a proximal end 43*p* thereof. The opening 48 formed by a substantially circular portion 49*a* complementary to the rotatable shaft 26 and key portions 49*b*, 49*c* complementary to a portion of an outer perimeter of the slide plate key 36. The outer plate 42 is rotatably mounted to the base unit 12. Specifically, the outer plate 42 is rotatably supported by an outer peripheral cylindrical surface of the rotatable shaft 26 that engages the substantially circular portion 49*a* of the opening 48 of the outer plate 42. As illustrated in FIGS. 1-6, in both the open and closed positions of the waste container 2, the outer plate 42 is oriented so that the key portions 49*b*, 49*c* of the opening 48 thereof are misaligned with the slide plate key 36. In both of these positions, the slide plate key 36 extends beyond the circular portion 49*a* of the opening 48 of the outer plate 42. Consequently, in both the open and closed positions of the waste container 2, the outer plate 42 is non-removably mounted to the rotatable shaft 26 of the base unit 12, and cannot be removed from the rotatable shaft 26. The outer plate 42 further includes an opening 50 provided for mounting one distal end of the locking bar 6 of the waste container 2 to the outer plate 42 of the safety locking device 10. Moreover, as best shown in FIG. 8, the inner plate 40 and the outer plate 42 are disposed on the rotatable shaft 26 between the casing 16 and the slide plate key 36.

A distal end 43*d* of the outer plate 42 is provided with a contact surface 52 slanted relative to side edge surfaces 54 of the outer plate 42, which extend between the proximal and distal ends 43*p* and 43*d*, respectively, thereof. In other words, the contact surface 52 of the outer plate 42 is oriented at an oblique angle (i.e., not 0°, 90° or 180°) relative to the side edge surfaces 54 of the outer plate 42 so that when the waste container 2 is tilted and opened to dump the waste into another container, such as a refuse vehicle, the contact surface 52 of the outer plate 42 is oriented substantially parallel to an opening edge of a refuse collection container of the refuse vehicle. Moreover, the side edge surface 54 of the outer plate 42, which faces the trunnion bar 5 in the open position of the locking bar 6, includes a position bump 56 oriented along the outer plate 42 so as to engage the trunnion bar 5 when the locking bar 6 is in the open position thereof (as best illustrated in FIGS. 2-4 and 20).

According to the present invention, the rolling member 34 is provided to translate from a first blocking position (shown in FIGS. 5-8 and 13) preventing pivoting movement of the pivoting unit 14 relative to the base unit 12 (thus, the locking bar 6 relative to the waste container 2) to a second release position (shown in FIGS. 9-12) permitting pivoting movement of the pivoting unit 14 relative to the base unit 12 (thus, of the locking bar 6 relative to the waste container 2). In other words, the rolling member 34 translates from the first blocking position preventing relative movement between the inner plate 40 and the casing 16 to the second release position permitting relative movement between the inner plate 40 and the casing 16. The slanted ramp 30 is fixed to the casing 16 so as to be oriented at an oblique angle relative to the bottom wall $\mathbf{20}_B$ of the casing 16 so as to bias the rolling member 34 to the first blocking position thereof.

Figure 11:
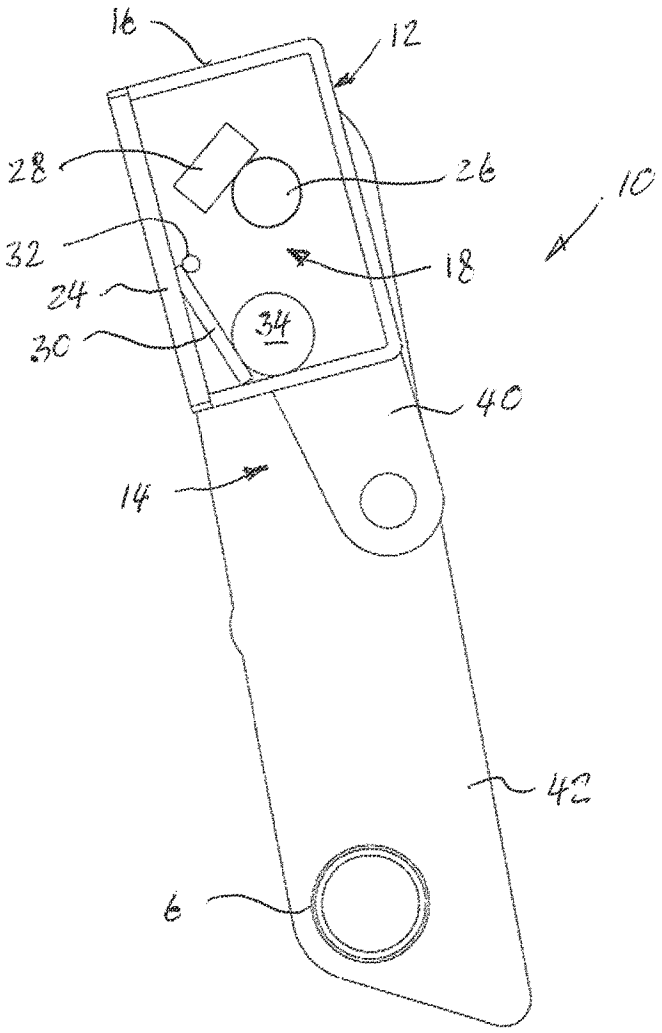
FIG. 11 is a side view of the locking device according to the first exemplary embodiment of the present invention in the tilted position with a locking bar in the open position, showing the locking mechanism in the release position in the casing without the rear cover plate and the padlock.
Figure 12:
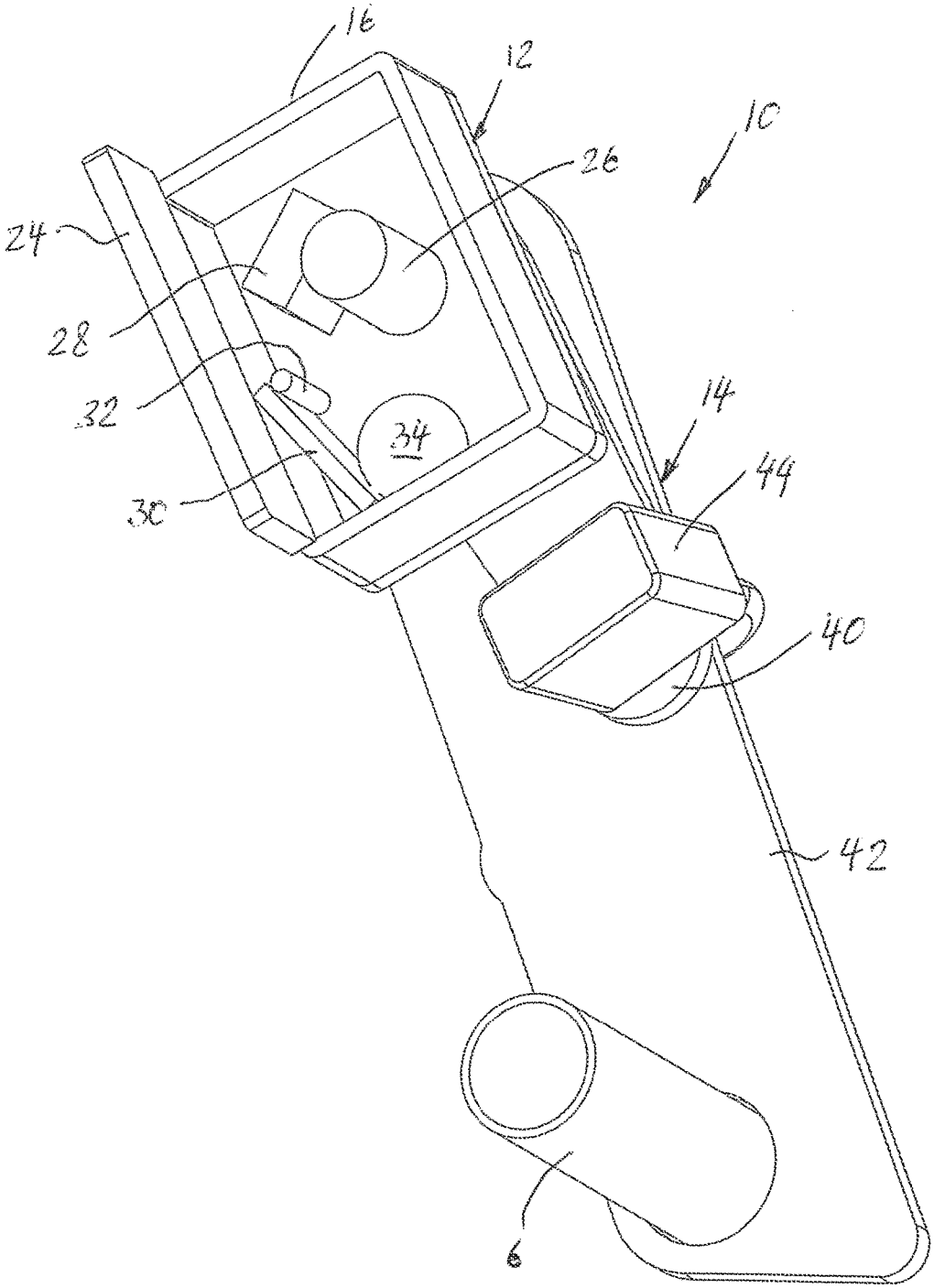
FIG. 12 is a perspective view of the locking device according to the first exemplary embodiment of the present invention in the tilted position with a locking bar in the open position, showing the locking mechanism in the release position in the casing without the rear cover plate and with the padlock.
Figure 13:
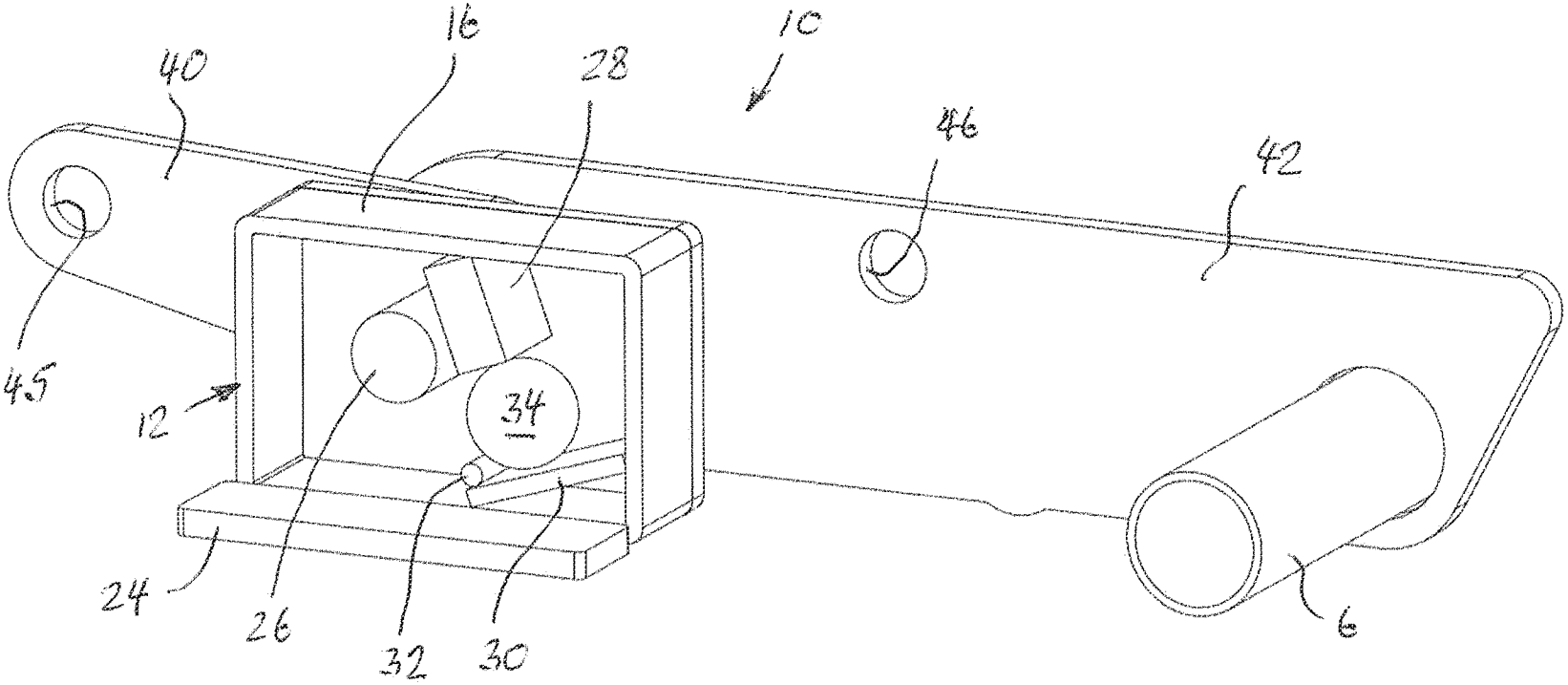
FIG. 13 is a side view of the locking device according to the first exemplary embodiment of the present invention with the locking bar in the open position, showing the locking mechanism in the blocking position in the casing without the rear cover plate and the padlock.

In the closed position of the pivotable unit 14 and the first blocking position of the rolling member 34 (shown in FIGS. 1 and 5-8), the rolling member 34 is engaged between the blocking member 28 and the slanted ramp 30 of the locking mechanism 18. As illustrated, the blocking member 28 and the slanted ramp 30 are opposite to and facing each other. The locking device 10 is mounted to the waste container 2 so that when the waste container 2 is in its upright storage position on the ground, the rolling member 34 is maintained in the first blocking position, i.e. in a far left position, thereof (shown in FIGS. 5-7) by gravity. Consequently, in the first blocking position thereof, the rolling member 34 is disposed between the blocking member 28 and the slanted ramp 30. In this position, the rolling member 34 blocks (prevents) the pivoting movement of the pivoting unit 14 relative to the base unit 12. In other words, the rolling member 34 is in the first blocking position (shown in FIGS. 5-7) and prevents the locking bar 6 from rotating relative to the waste container 2, thus maintaining the locking bar 6 in the closed position. However, by tilting the waste container 2 forwardly, in the direction of arrow A (shown in FIG. 2), the slanted ramp 30 becomes oriented generally horizontal and beyond, so that the rolling member 34 rolls by the force of gravity to the right as shown in FIGS. 9-12 within the cavity 17 away from the stop member 32 to the second release position thereof and no longer blocks the pivoting unit 14 from rotating relative to the base unit 12. Thus, in the second release position of the rolling member 34, the locking bar 6 can rotate relative to the waste container 2 from the closed position to the open position thereof, as illustrated in FIGS. 2, 11 and 12.

Figure 22:
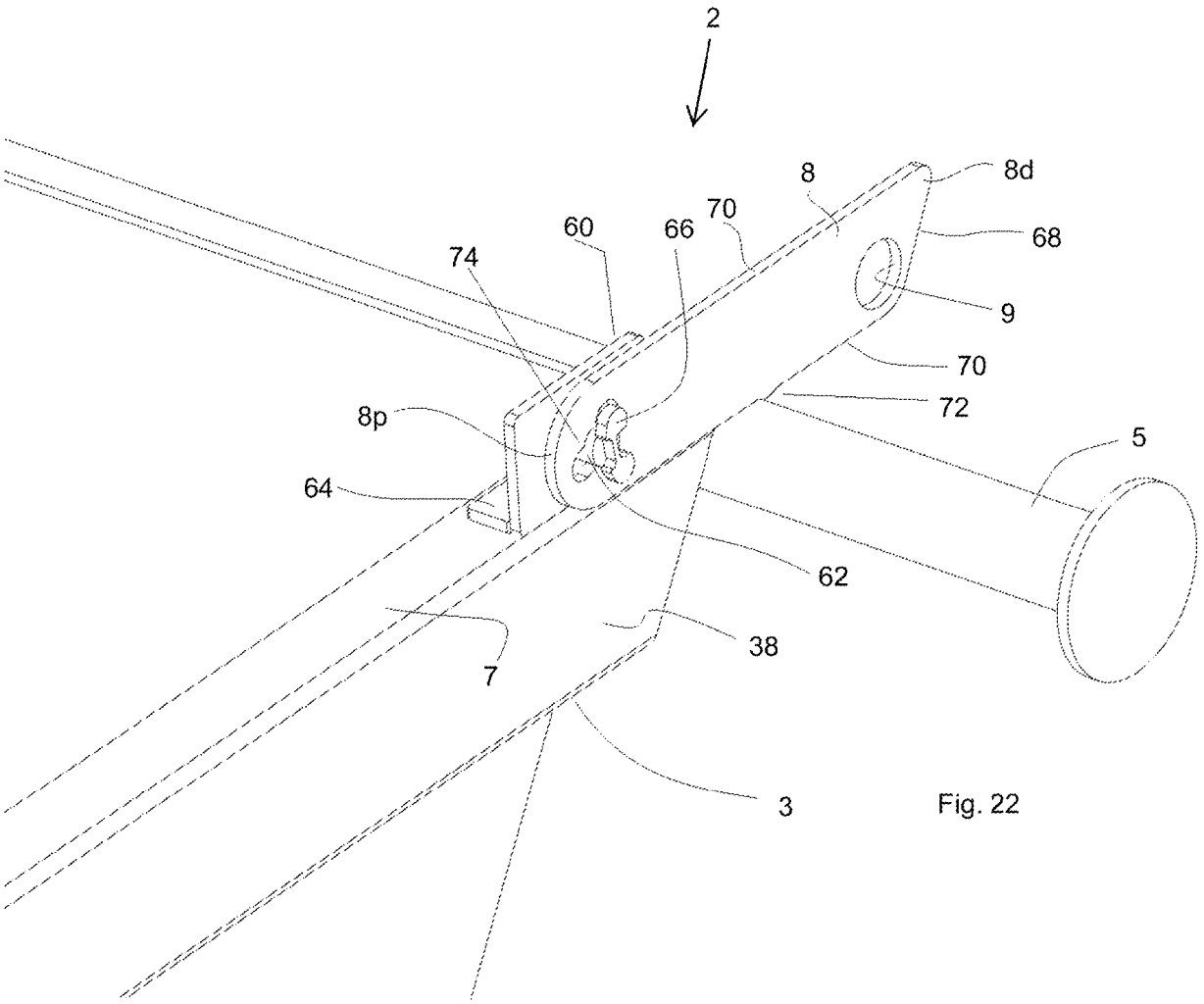
FIG. 22 is a partial perspective view of a dummy side of the waste container according to the first exemplary embodiment of the present invention in the upright position with the locking device in the open position.
Figure 23:
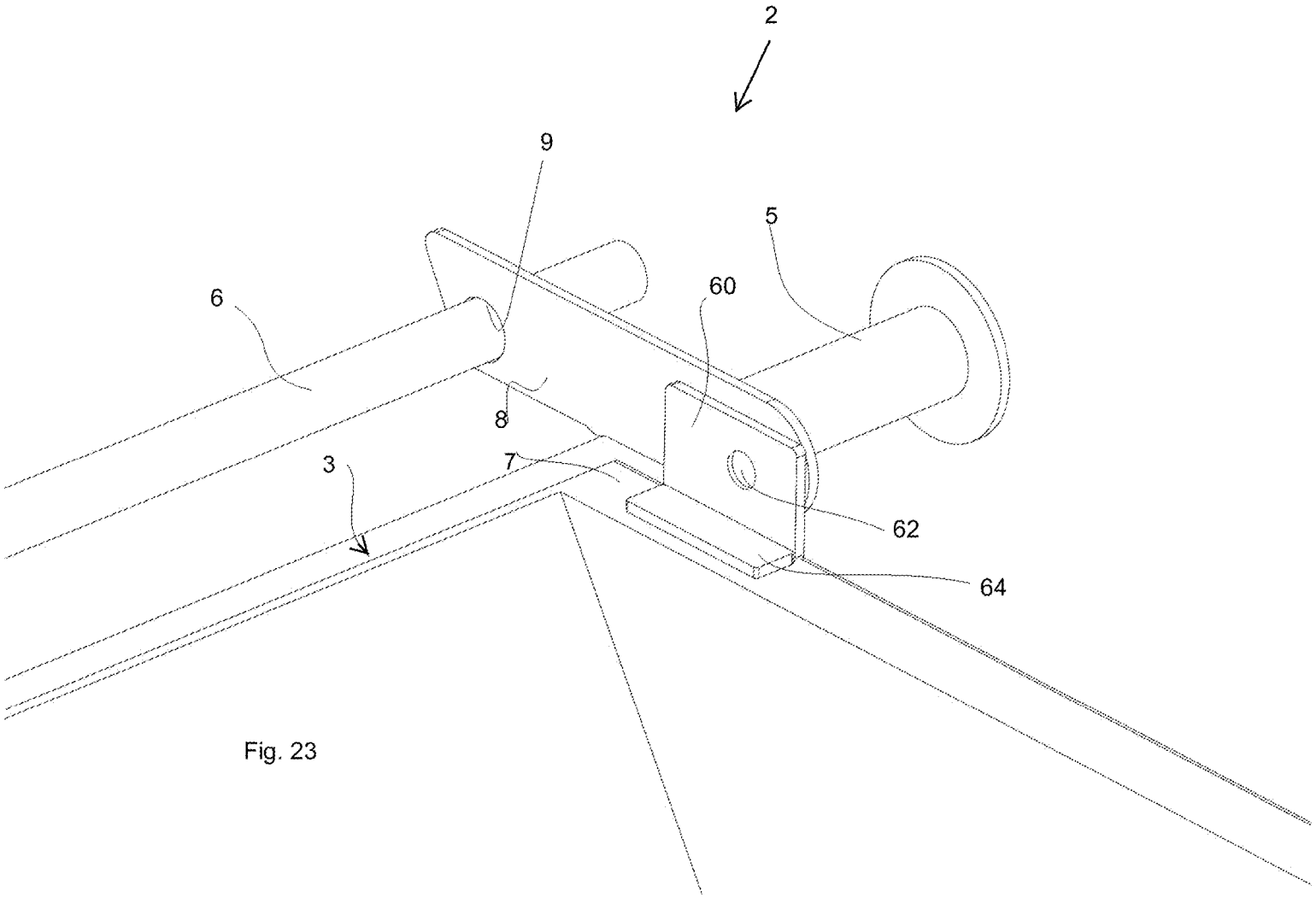
FIG. 23 is another partial perspective view of the dummy side of the waste container according to the first exemplary embodiment of the present invention in the upright position with the locking device in the open position and with the locking bar.

As further illustrated in FIGS. 22 and 23, the pivoting bar 8 is rotatably mounted to a base shaft 62 of a base plate 60 at a proximal end 8*p* of the pivoting bar 8. The base shaft 62 is non-movably attached (i.e., fixed) to the base plate 60. The base plate 60 non-movably attached (i.e., fixed) to or integrally formed with a mounting plate 64, which is, in turn, non-movably attached (i.e., fixed, such as by welding) to the channel 7 on the left side wall 3*b* of the container body 3 in a location opposite to the mounting plate 24 of the locking device 10. Alternatively, the base plate 60 may be fixed to the left side wall 3*b* of the container body 3. Moreover, the pivoting bar 8 is substantially similar to the outer plate 42 of the locking device 10. Specifically, a distal end 8*d* the pivoting bar 8 is provided with a contact surface 68 slanted relative to side edge surfaces 70 of the pivoting bar 8, which extend between the proximal and distal ends 8*p* and 8*d*, respectively, thereof. The contact surface 68 of the pivoting bar 8 is oriented at the same oblique angle relative to the side edge surfaces 70 of the pivoting bar 8 as the contact surface 52 of the outer plate 42. The pivoting bar 8 further includes an opening 9 provided for mounting one distal end of the locking bar 6 of the waste container 2 to the pivoting bar 8. Also similar to the outer plate 42, the side edge surface 70 of the outer plate 42, which faces the trunnion bar 5 in the open position of the locking bar 6, includes a position bump 72 oriented along the pivoting bar 8 so as to engage the trunnion bar 5 when the locking bar 6 is in the open position thereof (as best illustrated in FIGS. 22 and 23).

A distal end of the base shaft 62 is provided with a slide plate key 66. As best illustrated in FIG. 22, the slide plate key 66 is axially spaced from the base plate 60. In the first exemplary embodiment of the present invention, the slide plate key 66 is non-movably attached (i.e., fixed) to the distal end of the base shaft 62. As further illustrated in FIG. 22 and similarly to the side plate 42, the pivoting bar 8 has an opening 74 therethrough provided at the proximal end 8*p* thereof. The opening 74 is formed by a substantially circular portion complementary to the rotatable shaft 62 and key portions complementary to a portion of an outer perimeter of the slide plate key 66. As illustrated in FIG. 22, the pivoting bar 8 is rotatably mounted to the base plate 60. Specifically, the pivoting bar 8 is rotatably supported by an outer peripheral cylindrical surface of the base shaft 62 that engages the substantially circular portion of the opening 74 the pivoting bar 8. As further illustrated in FIG. 22, in both the open and closed positions of the waste container 2, the pivoting bar 8 is oriented so that the key portions of the opening 74 thereof are misaligned with the slide plate key 66. In both of these positions, the slide plate key 66 extends beyond the circular portion of the opening 74 of the pivoting bar 8. Consequently, in both the open and closed positions of the waste container 2, the pivoting bar 8 is non-removably mounted to the base shaft 62 of the base plate 60, and cannot be removed from the base shaft 62.

Figure 16:
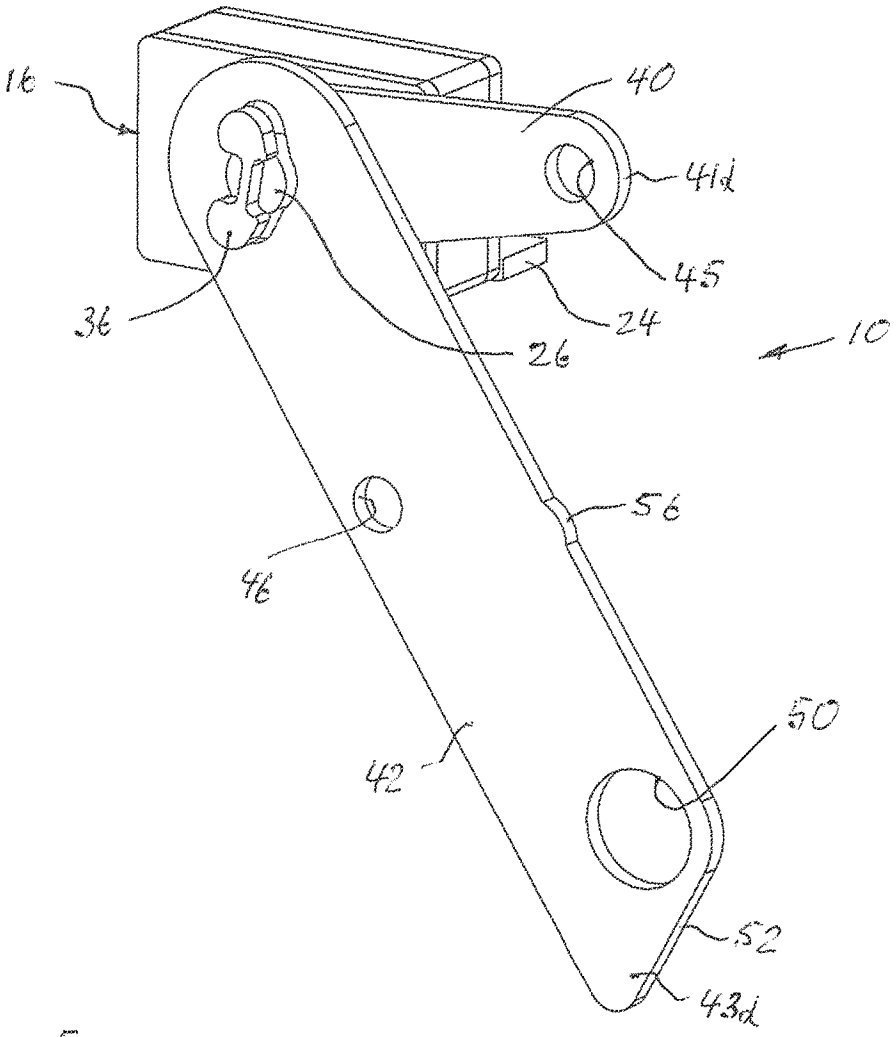
FIG. 16 is a perspective view of the locking device according to the first exemplary embodiment of the present invention with the outer plate mounted to the locking mechanism.
Figure 17:
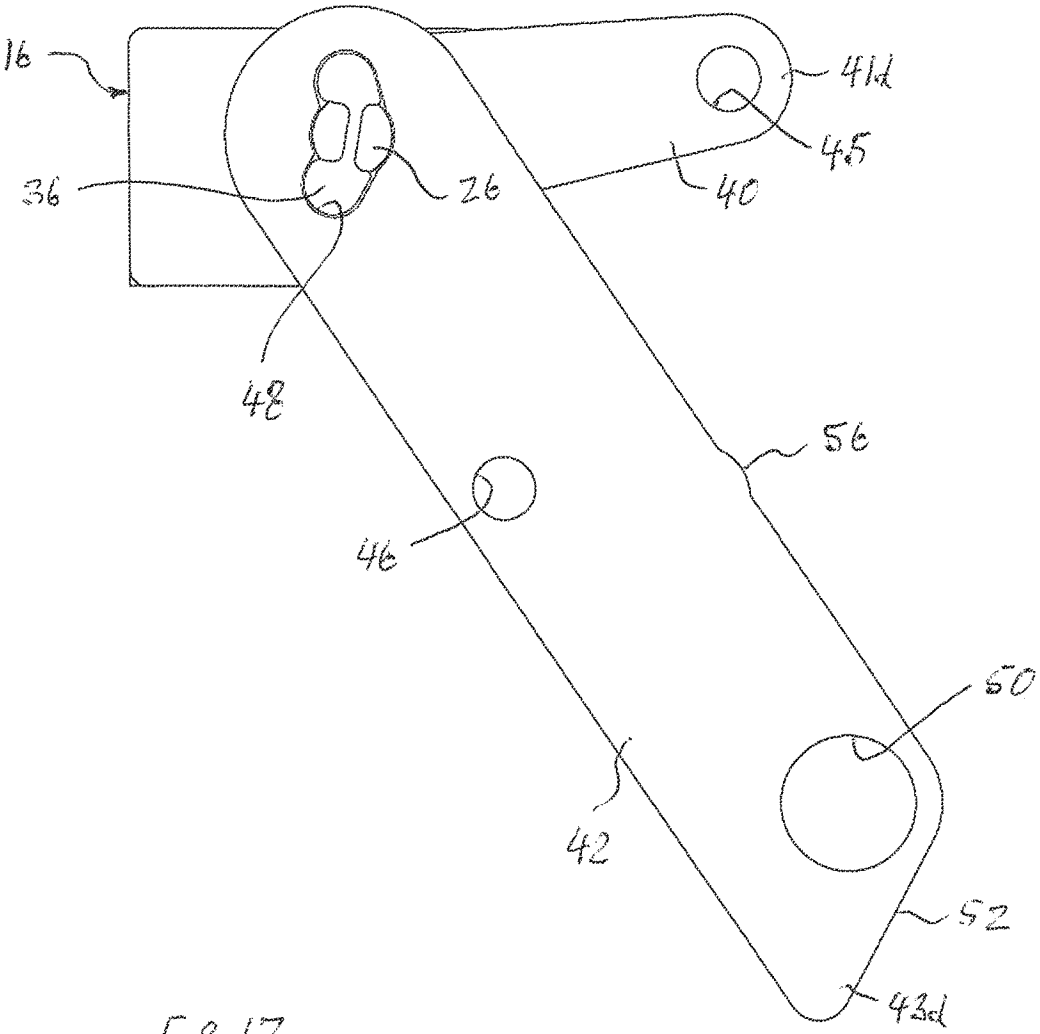
FIG. 17 is a side view of the locking device according to the exemplary embodiment of the present invention with the outer plate mounted to the locking mechanism.

During the assembly of the locking device 10, first, the mounting plate 24 of the base unit 12 with the casing 16 and the locking mechanism 18 is fastened (such as by welding or threaded fasteners) to the channel 7 on the right side wall 3*a* of the waste container 2. Then, the inner plate 40 is fixed to the rotatable shaft 26. Next, the slide plate key 36 is non-movably attached to the distal end 27 of the rotatable shaft 26. Then, the outer plate 42 is oriented so as to register the key portions 49*b*, 49*c* of the opening 48 of the outer plate 42 with the slide plate key 36, as shown in FIG. 14. Next, the outer plate 42 is slid over and past the slide plate key 36 so that the circular portion 49*a* of the opening 48 of the outer plate 42 engages the outer peripheral cylindrical surface of the rotatable shaft 26, as shown in FIGS. 16 and 17. After that, the outer plate 42 is rotated so that the opening 48 in the outer plate 42 and the slide plate key 36 are angularly offset (i.e., not registered or aligned), as shown in FIGS. 1-4, 18 and 19.

Similarly, the base plate 60 with the base shaft 62 and the mounting plate 64 are fastened (such as by welding or threaded fasteners) to the channel 7 on the left side wall 3*b* of the waste container 2. Next, the slide plate key 66 is non-movably attached to the free distal end of the base shaft 62. Then, the pivoting bar 8 is oriented so as to register the key portions of the opening 74 of the pivoting bar 8 with the slide plate key 66. Next, the pivoting bar 8 is slid over and past the slide plate key 66 so that the circular portion of the opening 74 of the pivoting bar 8 engages the outer peripheral cylindrical surface of the base shaft 62. After that, the pivoting bar 8 is rotated so that the opening 74 in the pivoting bar 8 and the slide plate key 66 are angularly offset (i.e., not registered or aligned), as shown in FIG. 22.

Figure 20:
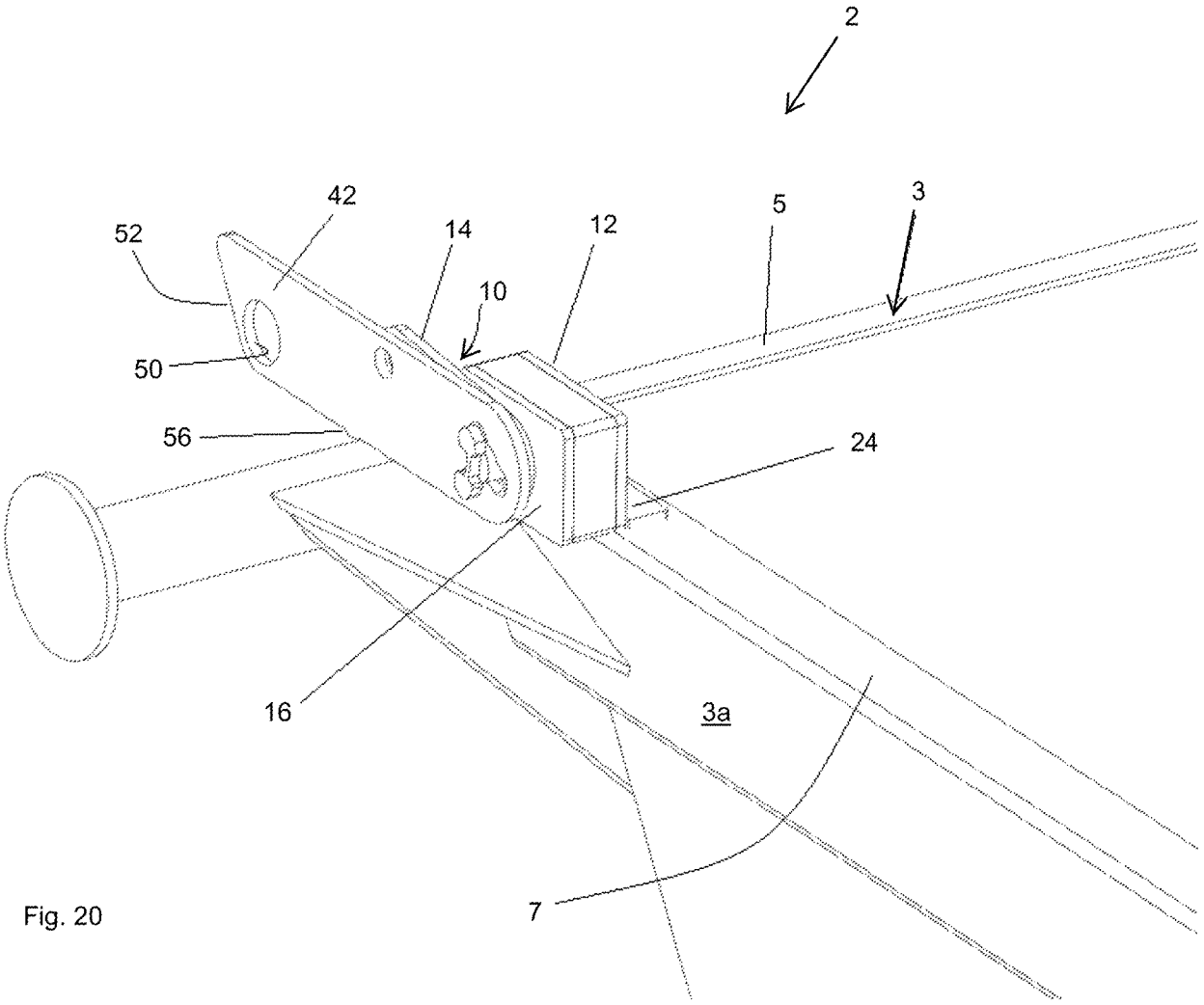
FIG. 20 is a partial perspective view of a lock side of the waste container according to the first exemplary embodiment of the present invention in the upright position with the locking device shown in the open position and without a locking bar and the padlock.
Figure 21:
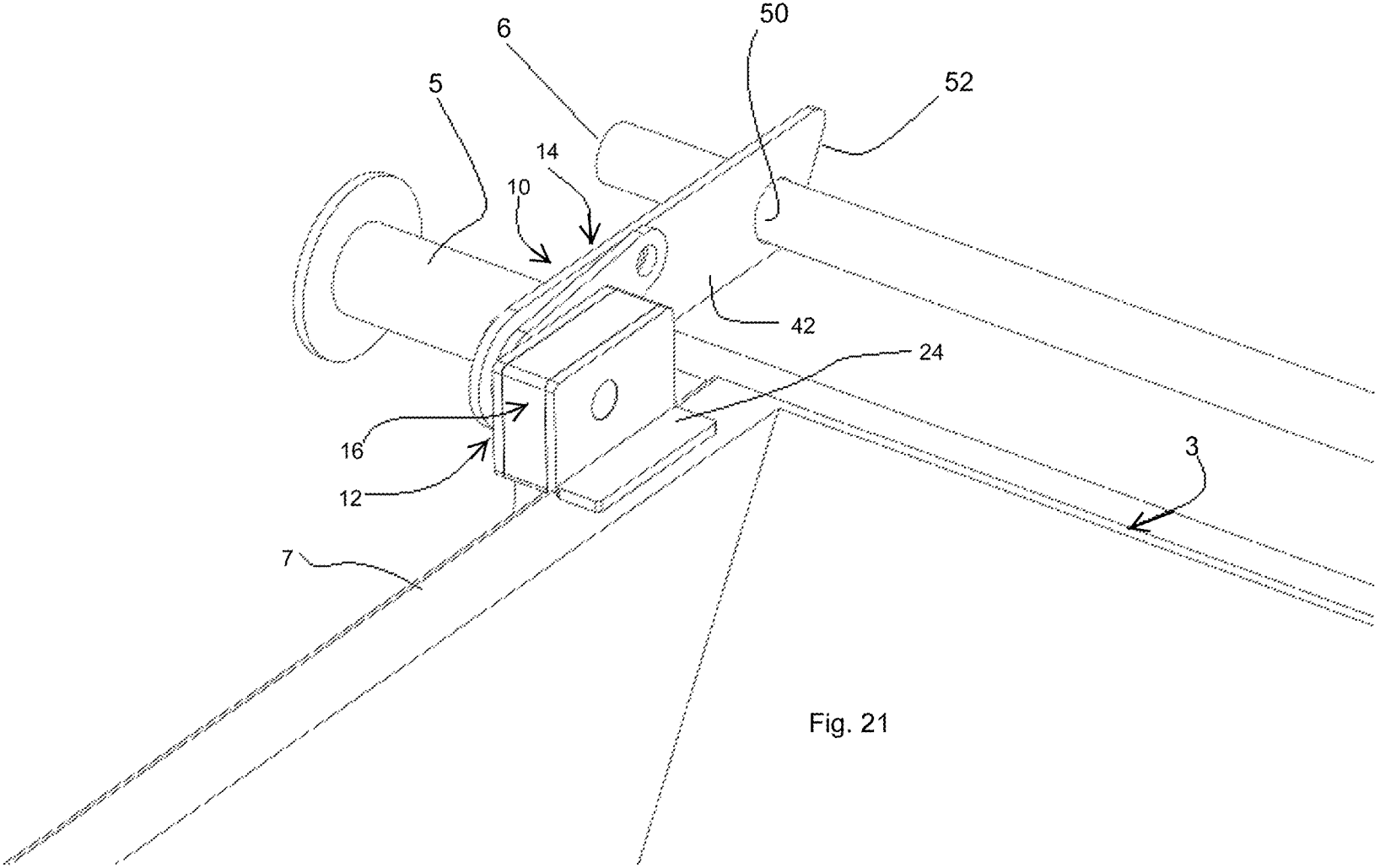
FIG. 21 is another partial perspective view of the lock side of the waste container according to the first exemplary embodiment of the present invention in the upright position with the locking device shown in the open position and with the locking bar and the padlock.

Next, the outer plate 42 and the pivoting bar 8 are rotated so the position bumps 56 and 72 of the outer plate 42 and the pivoting bar 8, respectively, are placed of the trunnion bar 5, as best illustrated in FIGS. 4 and 20 and 22. Then, the locking bar 6 is mounted to the pivoting bar 8 and the outer plate 42 by inserting the locking bar 6 into the openings 9 and 50 of the pivoting bar 8 and the outer plate 42, respectively, so that the locking bar 6 extends between the pivoting bar 8 and the outer plate 42, as illustrated in FIGS. 21 and 23. Subsequently, the locking bar 6 is fixed, such as by welding, to the pivoting bar 8 and the outer plate 42 at the opposite ends thereof.

Figure 18:
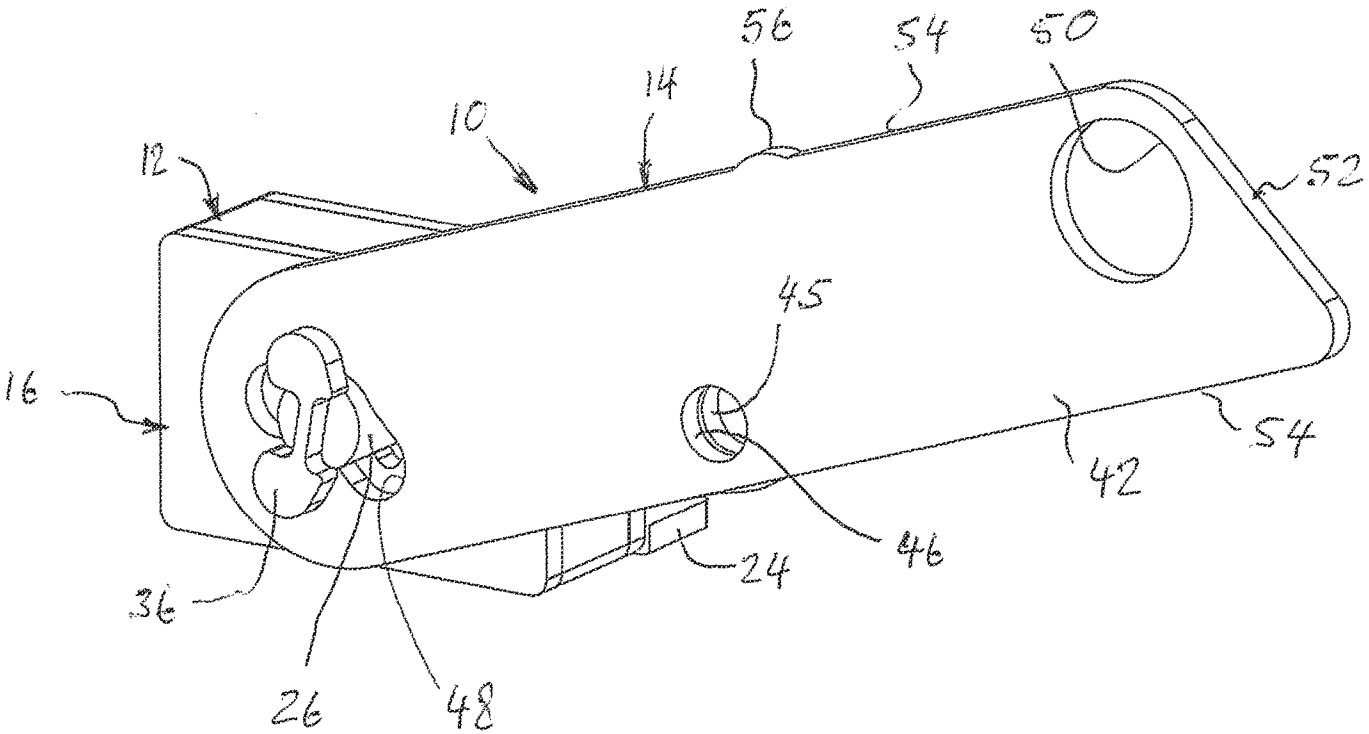
FIG. 18 is a perspective view of the locking device according to the first exemplary embodiment of the present invention with the inner plate aligned with the outer plate.
Figure 19:
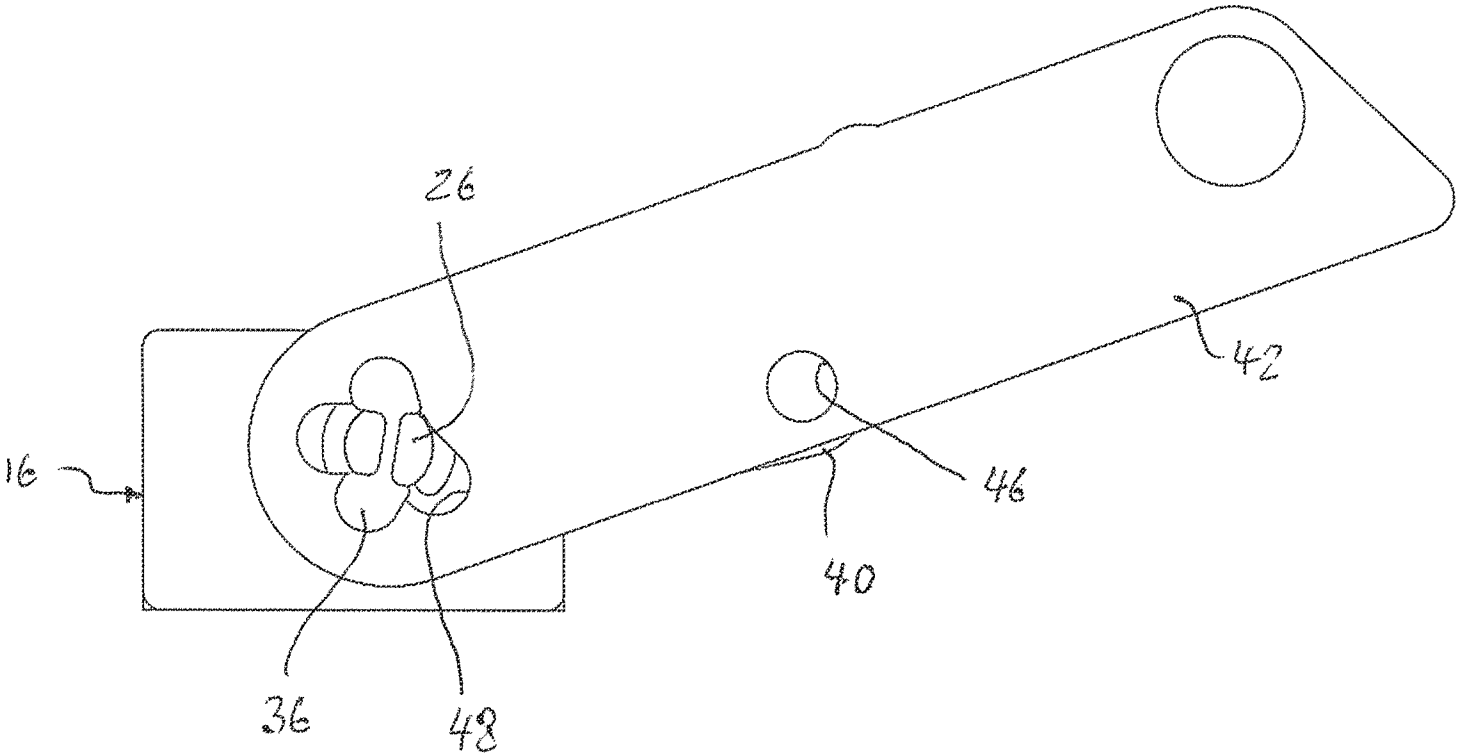
FIG. 19 is a side view of the locking device according to the first exemplary embodiment of the present invention with the inner plate aligned with the outer plate.

After that, the outer plate 42 is rotated to register the aperture 46 in the outer plate 42 with the aperture 45 in the inner plate 40, as shown in FIGS. 18 and 19. Then, the padlock 44 is placed through the holes 45 and 46 in the inner plate 40 and the outer plate 42 in order to lock together the inner plate 40 and the outer plate 42 of the pivoting unit 14. In order to bypass the locking mechanism 18, the padlock 44 is unlocked and removed from the outer plate 42 to unlock the outer plate 42 from the inner plate 40, then rotated the outer plate 42 to a position shown in FIG. 4. In this position, the locking bar 6 is horizontally spaced away from the hinged lid 4 of the waste container 2 so as to allow the opening of the hinged lid 4 of the waste container 2. In other words, the locking device 10 allows bypassing the gravity operated locking mechanism 18 by rotating the outer plate 42 by an authorized person.

In operation, when it is desirable to empty the refuse, the waste container 2 is grabbed by a lifting mechanism of a waste collection truck (not shown), and is moved from the upright storage position to the tilted or dumping position. Initially, the rolling member 34 of the gravity operated locking mechanism 18 is in the first blocking position (as shown in FIGS. 5-8). When the waste container 2 is substantially tipped forward or tilted at a predetermined angle, preferably about 30°, the rolling member 34 rolls by gravity from the blocking position to the release position along the rolling surface 43*a* of the slanted ramp 30. In this position the rolling member 34 no longer blocks the pivotal movement of the blocking member 28, and the pivoting unit 14 is allowed to pivot to its open position. Consequently, the inner plate 40 of the pivoting unit 14 and the locking bar 6 move by gravity from the closed position to the open position thereof (shown in FIGS. 2, 11 and 12). Sequentially, the lid 4 of the waste container 2 swings open by gravity permitting the contents of the waste container 2 to be emptied. It will be appreciated that the gravity operated locking mechanism 18 operates automatically and independently of locking condition of the outer plate 42. In other words, when the waste container 2 is tilted, the locking mechanism 18 is open whether the outer plate 42 is locked with the padlock 46 to the inner plate 40 or not. As the waste container 2 is returned to its initial upright storage position, the lid 4 closes by gravity, then the pivoting unit 14 and the locking bar 6 move by gravity to the closed position, and the rolling member 34 is returned to the blocking position.

As described above, manual release of the lid 4 of the waste container 2 by an authorized person can be achieved the outer plate 42. When the padlock 44 is in place (i.e. the outer plate 42 is in the locked position), the movement of the outer plate 42 relative to the inner plate 40 is restricted. When the padlock 44 is removed by an authorized person using a designated key, the outer plate 42 is allowed to pivot to a position shown in FIG. 4. In this position, the locking bar 6 is horizontally spaced away from the hinged lid 4 of the waste container 2 so as to allow the opening of the hinged lid 4 of the waste container 2.

FIGS. 24-31 illustrate a second exemplary embodiment of a waste or storage container, generally depicted by the reference character 102. Components, which are unchanged from the first exemplary embodiment of the present invention, are labeled with the same reference characters. Components, which function in the same way as in the first exemplary embodiment of the present invention depicted in FIGS. 1-23 are designated by the same reference numerals to some of which 100 has been added, sometimes without being described in detail since similarities between the corresponding parts in the two embodiments will be readily perceived by the reader.

Figure 24:
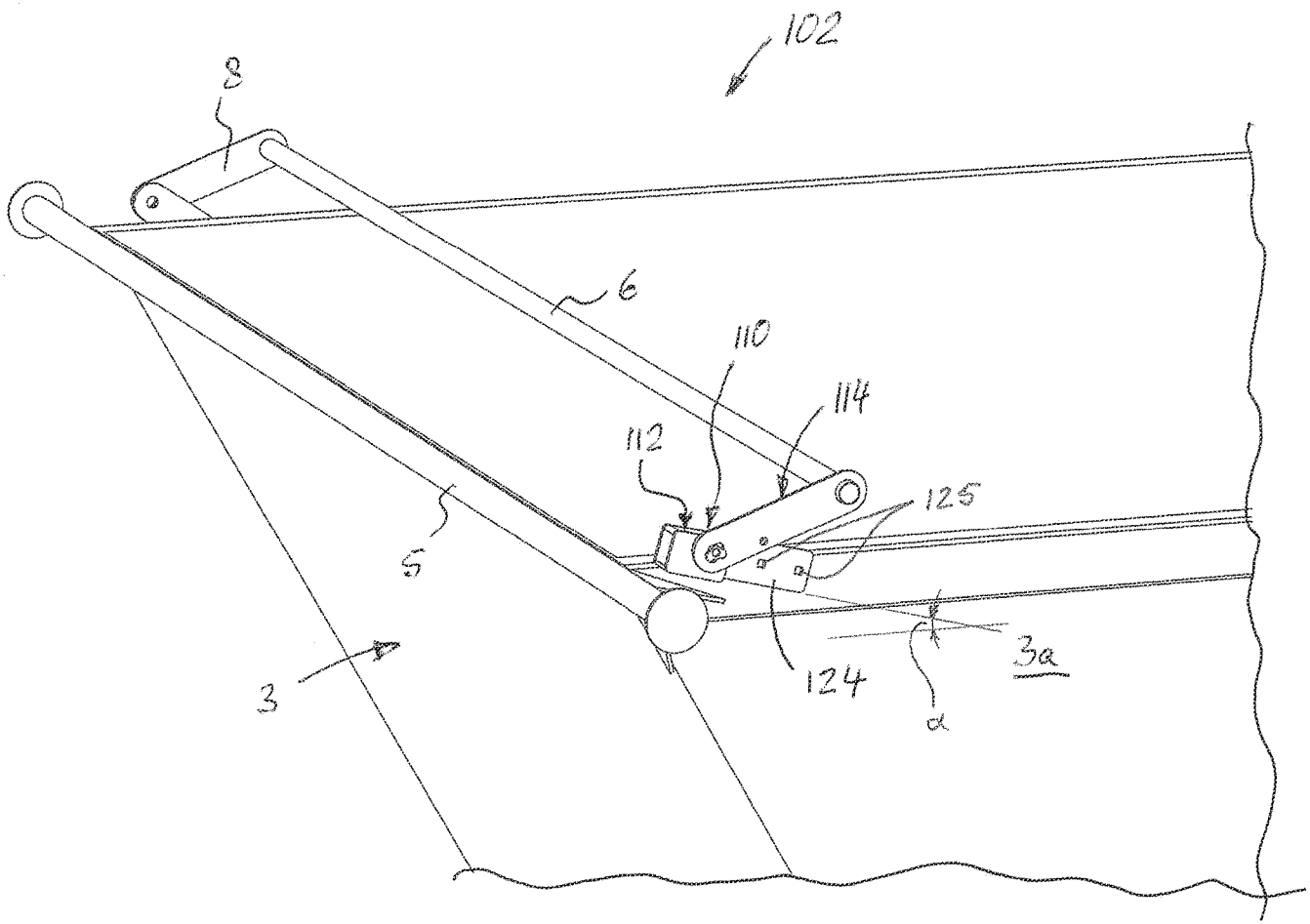
FIG. 24 is a perspective view of a waste container in an upright position with a locking device according to a second exemplary embodiment of the present invention shown in a closed position.
Figure 25:
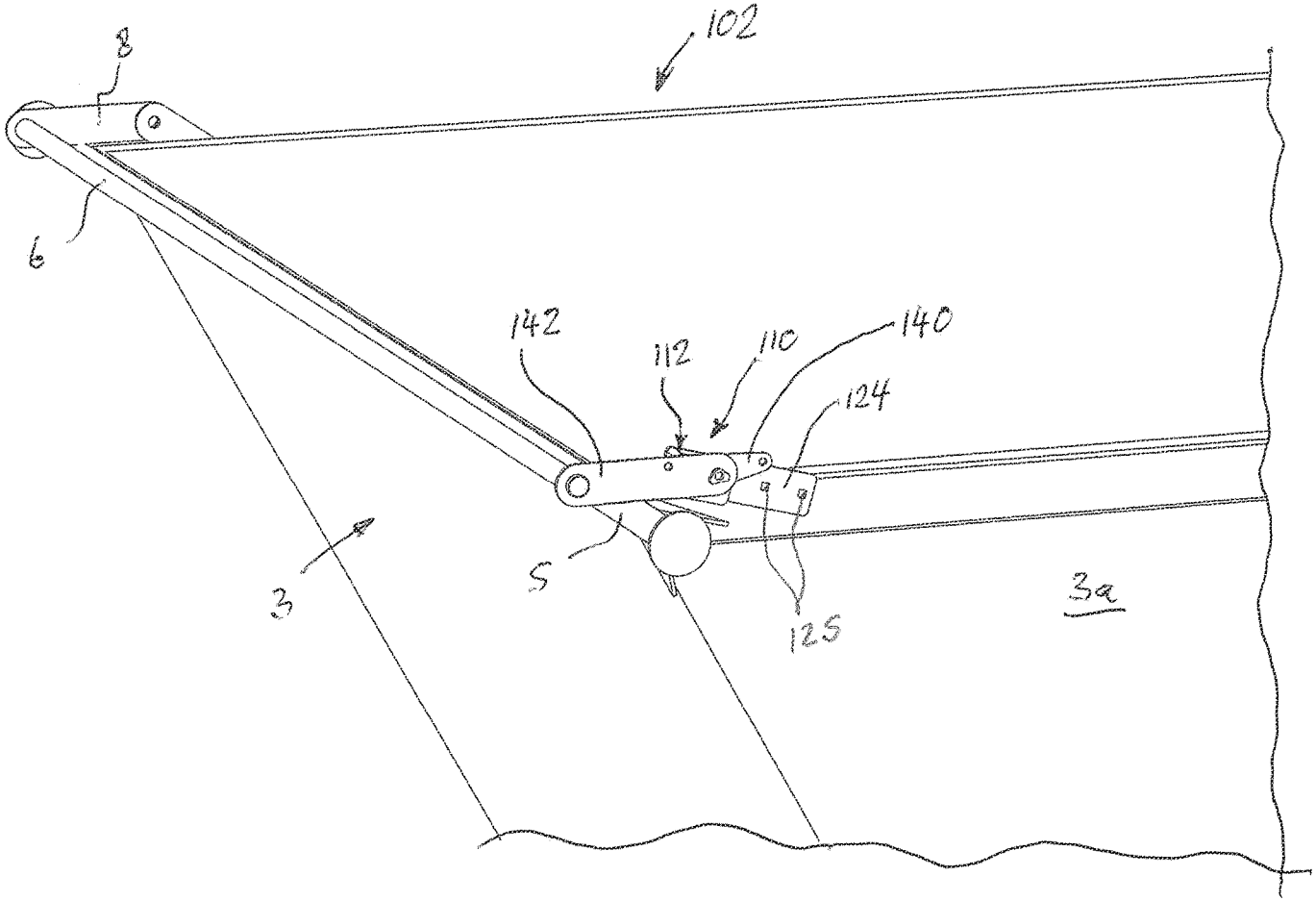
FIG. 25 is a perspective view of the waste container of FIG. 24 in the upright position with the locking device shown in the open position without the padlock and with an outer plate of a pivotable unit separated from an inner plate.

The container 102 includes a container body 3, at least one hinged lid 4 pivotally mounted thereto, a safety locking device 110, a locking bar 6 extending substantially across the length of the waste container 102, as illustrated in FIGS. 24 and 25, and a trunnion bar 5 non-movably secured (i.e., fixed) to the container body 3, such as by welding, so as to extend substantially parallel to the locking bar 6. The container 102 of FIGS. 24-31 corresponds substantially to the container 2 of FIGS. 1-23, and only the locking device 110, which differs, will therefore be explained in detail below.

Figure 26:
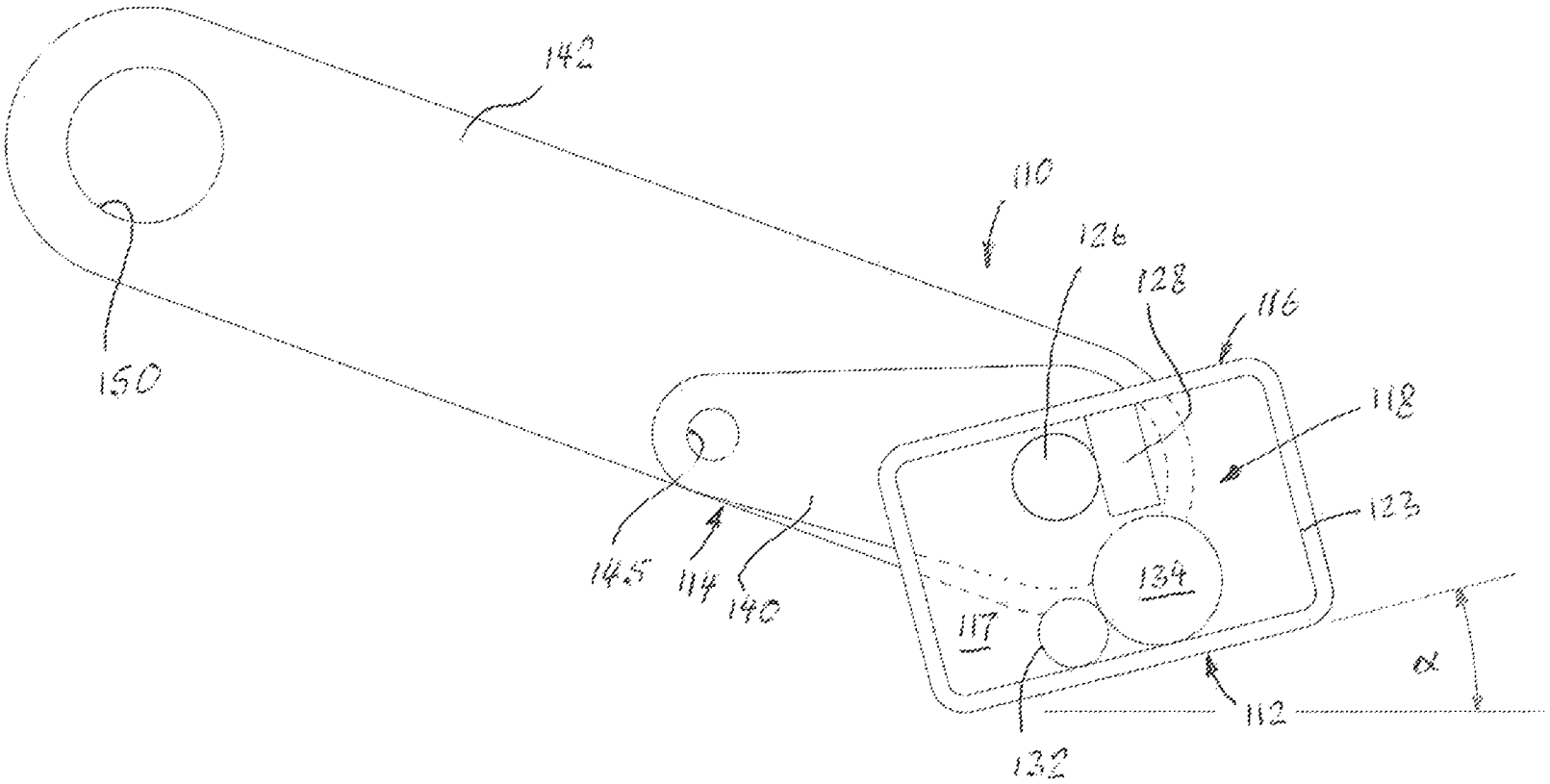
FIG. 26 is a side view of the locking device according to the second exemplary embodiment of the present invention in the closed position, showing the locking mechanism in the blocking position in the casing without the rear cover plate and the padlock.
Figure 27:
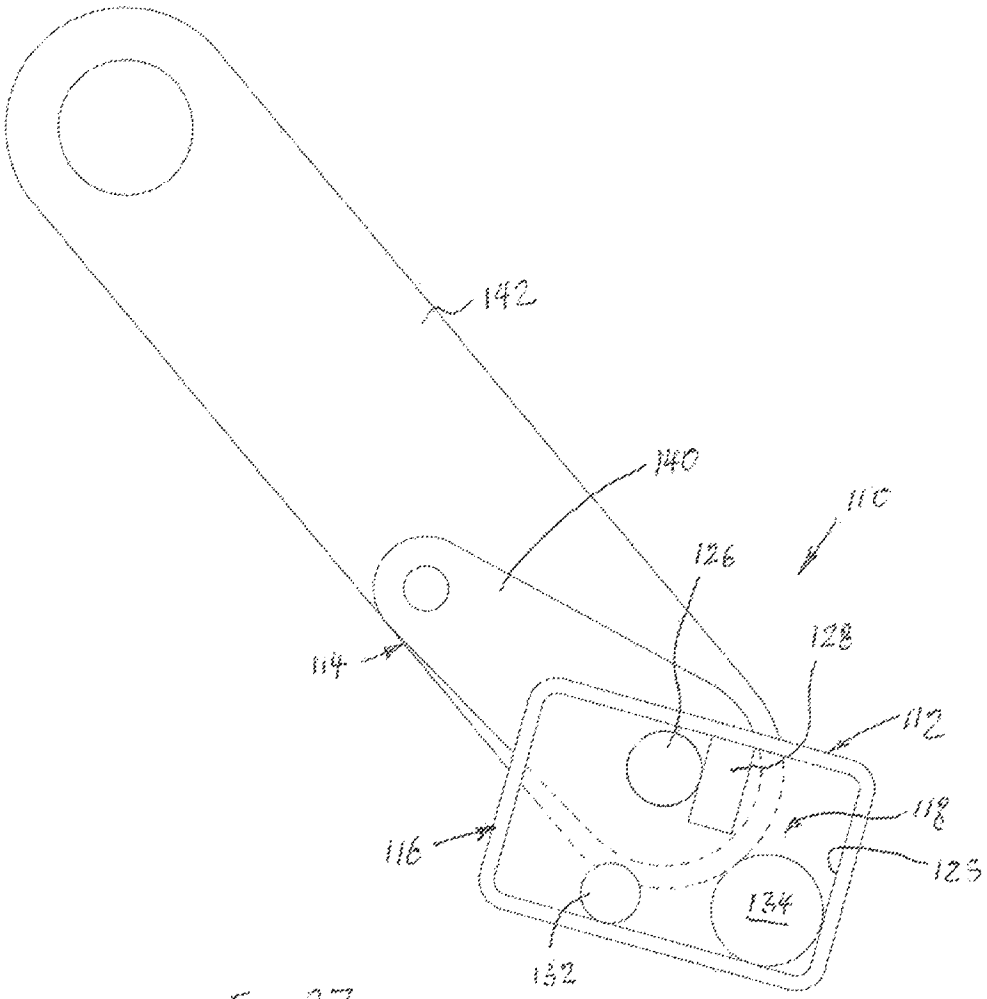
FIG. 27 is a side view of the locking device according to the second exemplary embodiment of the present invention in a tilted position, showing the locking mechanism in a release position in the casing without the rear cover plate and the padlock.
Figure 22:
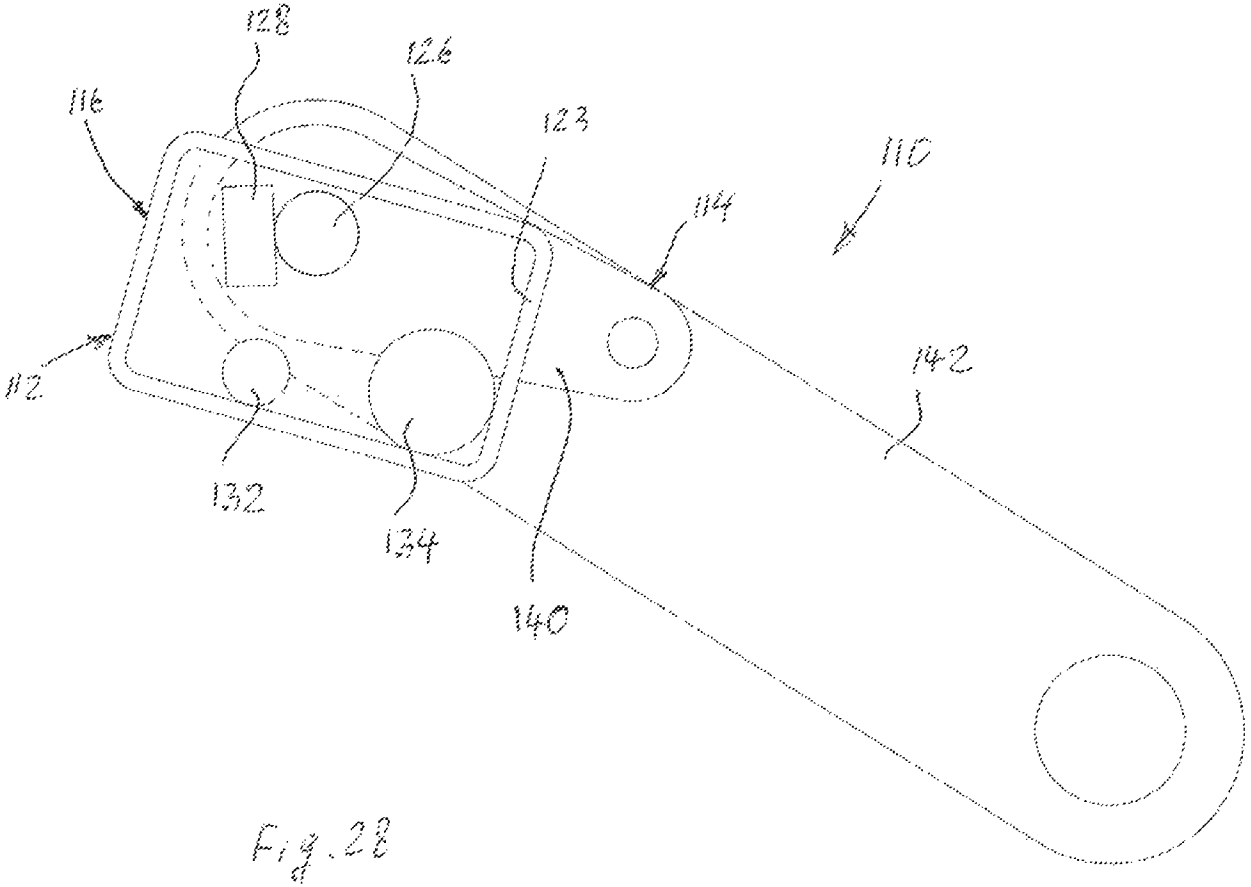

The locking device 110 according to the second exemplary embodiment of the present invention, as illustrated in detail in FIGS. 26-28, comprises a base unit 112 fixed to the right side wall 31 of the waste container 102, and an elongated pivotable unit 114 pivotally mounted to the base unit 112 for pivotable movement relative to the base unit 112. The locking bar 6 is secured to the pivotable unit 114 at a distal end thereof so as to extend substantially across the length of the waste container 102, as illustrated in FIGS. 24 and 25. The pivotable unit 114, the pivoting bar 8 and the locking bar 6 movable therewith are provided to translate from a closed position (shown in FIG. 24) to an open position (shown in FIG. 25) wherein the locking bar 6 is horizontally spaced away from the container body 3.

Figure 29:
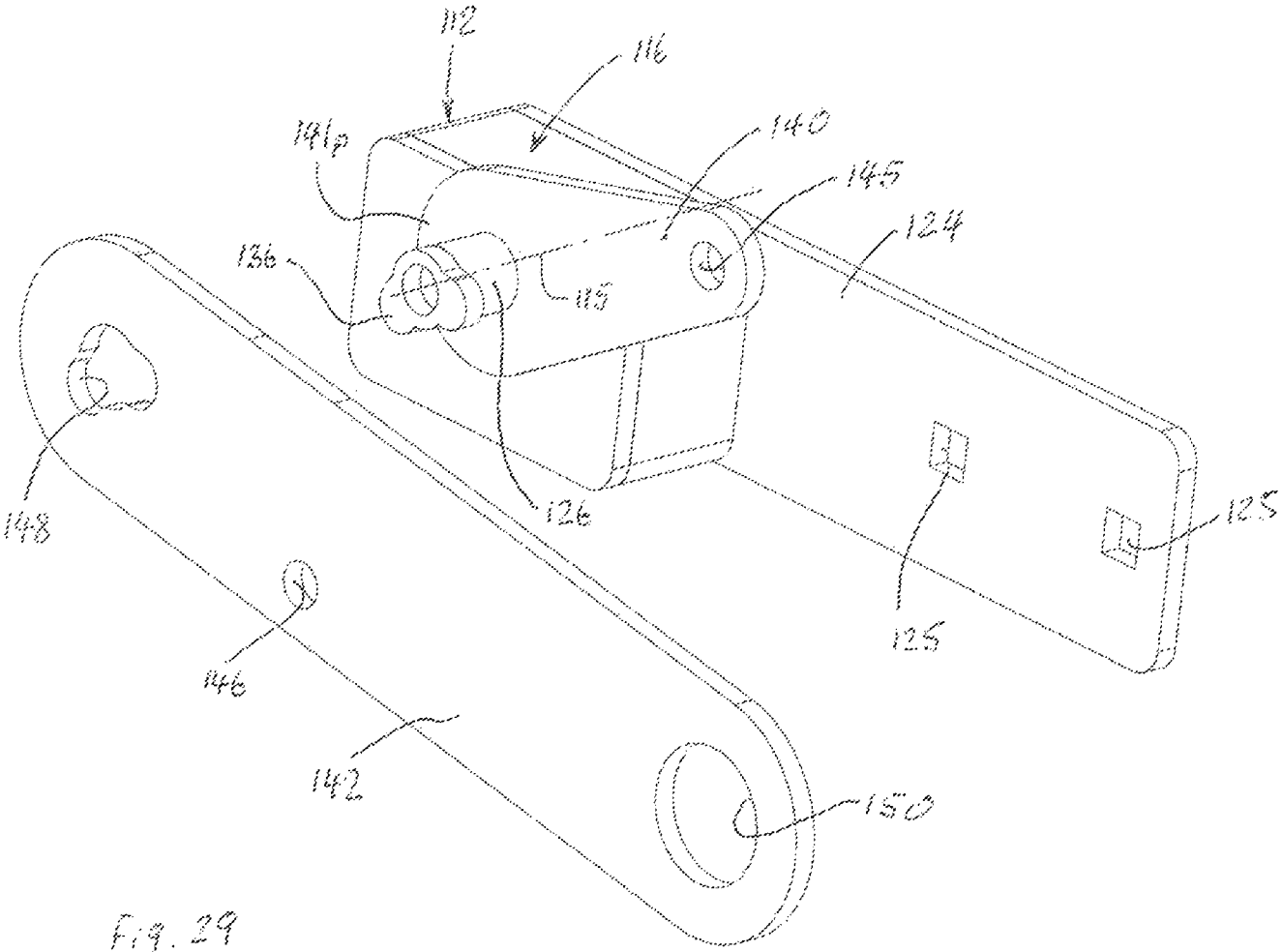
FIG. 29 is a perspective view of the locking device according to the second exemplary embodiment of the present invention with the inner plate mounted to the locking mechanism and the outer plate separated from the locking mechanism.

The base unit 112, as illustrated in detail in FIGS. 26-28, comprises a hollow casing 116 defining a cavity 117 therewithin, and an automatic, pivoting, gravity operated locking mechanism 118 disposed in the casing 116. The base unit 112 further comprises a mounting plate 124 non-movably attached (i.e., fixed) to the casing 116, such as by welding. Preferably, as illustrated in FIGS. 24, 25 and 29, the base member 124 is in the form of a flat metal plate fastened to the right side wall 3*a* of the container body 3 by threaded fasteners (not shown in detail) extending through holes 125 therethrough. The locking device 110 is mounted to the container body 3 by fixing (such as by threaded fasteners or welding) the mounting plate 124 to the right side wall 3*a* of the container body 3, as shown in FIGS. 24-25, so that when the container body 3 is disposed in an upright position, the casing 116 is oriented at an oblique angle $\alpha$ relative to the horizontal line, as shown in FIG. 26. Thus, the locking mechanism 118 is adapted to rotate (pivot) with the waste container 102.

The locking mechanism 118 comprises a rotatable shaft 126 extending through the casing 116, a blocking member 128 non-movably secured (i.e., fixed) to an outer peripheral surface of the shaft 126 such as by welding, a stop member 132 fixed to the casing 116, and a rolling member 134 movably disposed within the casing 116 between the stop member 132 and a side wall 23 of the casing 116. In the second exemplary embodiment of the present invention the rolling member 134 is in the form of a spherical ball. Alternatively, the rolling member 134 is in the form of a cylindrical disc. The casing 116 is fixed to the container body 3 so as to be oriented at an oblique angle (i.e., not 0°, 90° or 180°) relative to the horizontal line when the container body 3 is disposed in an upright position, as shown in FIGS. 24-26. The stop member 132 is provided to retain the rolling member 134 within the casing 116 so that the rolling member 134 is movable between the stop member 132 and the side wall 123 of the casing 116.

Figure 30:
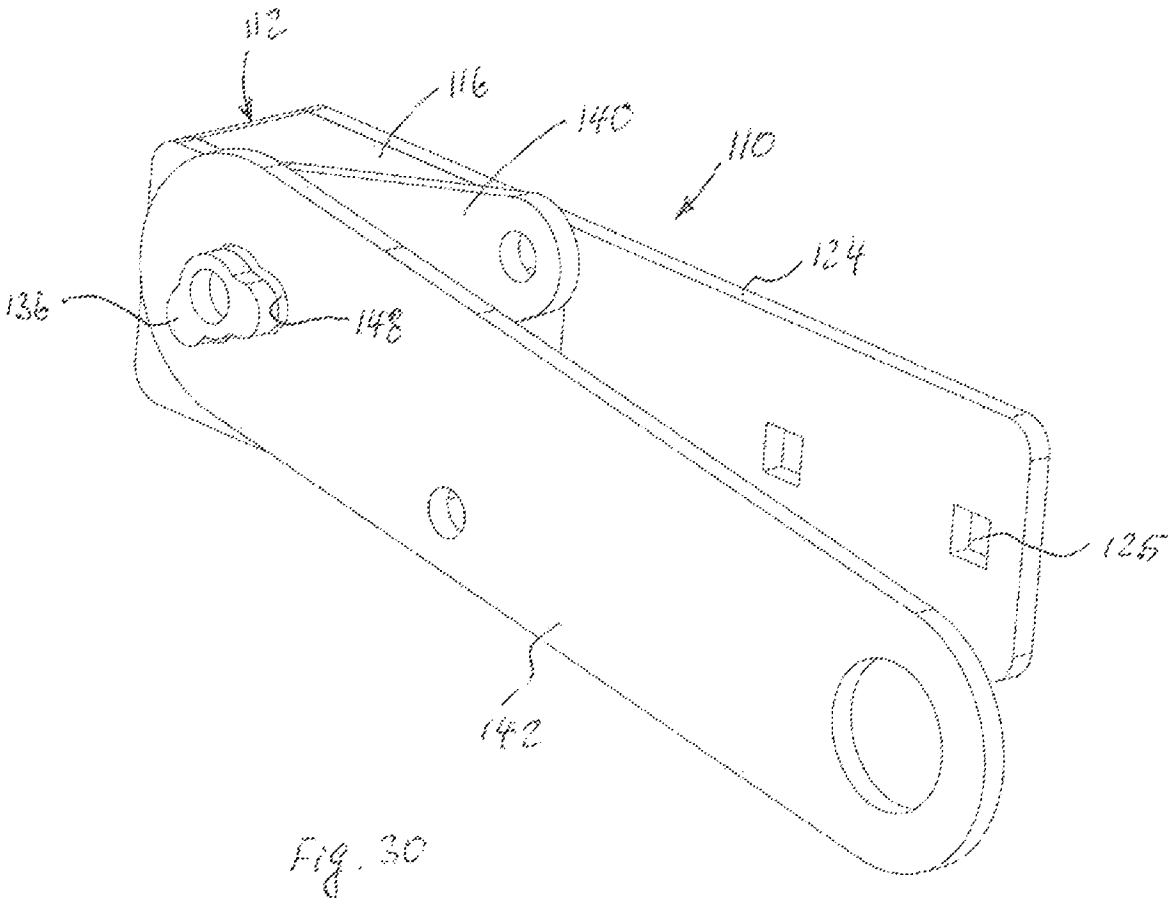
FIG. 30 is a perspective view of the locking device according to the second exemplary embodiment of the present invention with the outer plate mounted to the locking mechanism.
Figure 31:
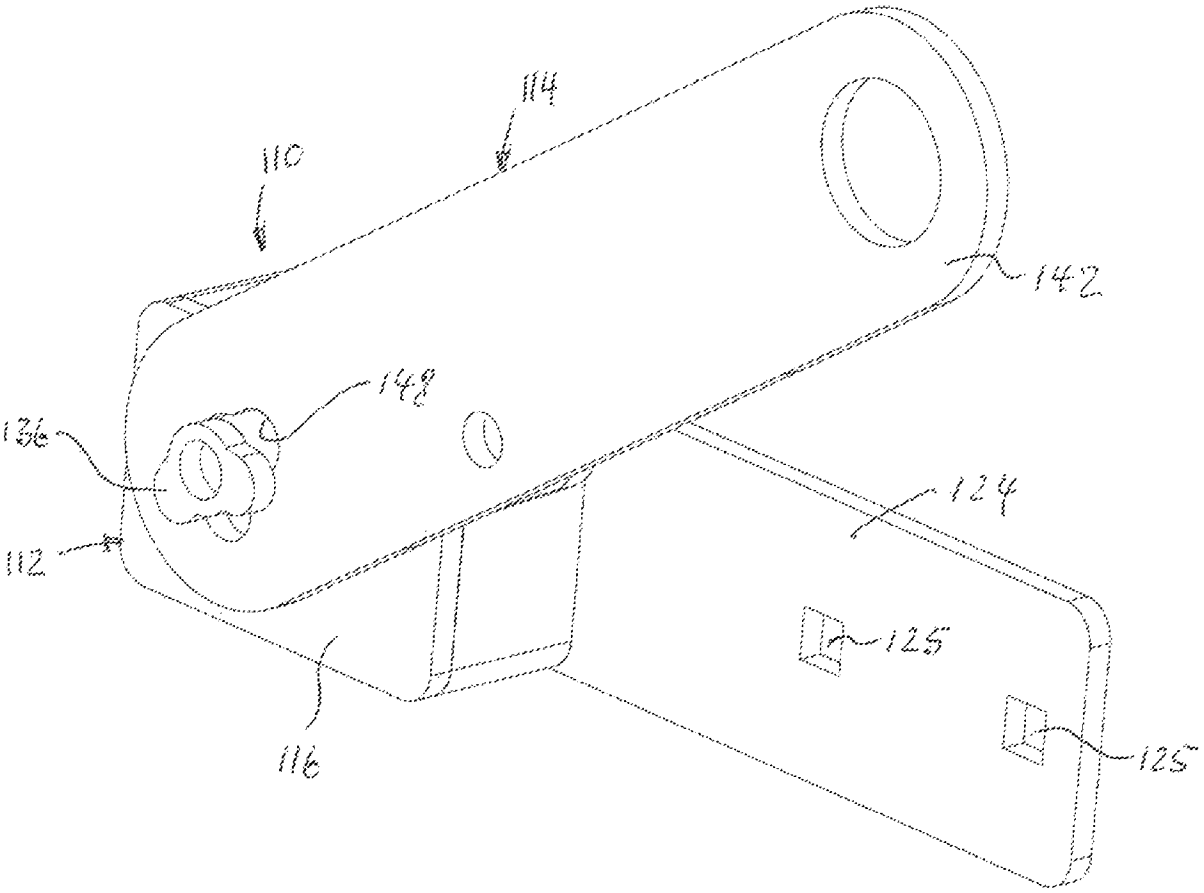
FIG. 31 is a perspective view of the locking device according to the second exemplary embodiment of the present invention with the inner plate aligned with the outer plate.

As further illustrated in FIGS. 29-31, the pivotable unit 114 comprises an inner plate 140 non-movably attached (i.e., fixed) to the rotatable shaft 126 of the locking mechanism 118, and a outer plate 142 rotatably mounted to the rotatable shaft 126 and pivotally movable relative to the inner plate 140. Moreover, the inner plate 140 is oriented substantially parallel to the outer plate 142. The inner plate 140 is non-movably fixed to the rotatable shaft 126 adjacent to a proximal end 141*p* of the inner plate 140.

A distal end of the rotatable shaft 126, disposed outside the casing 116, is provided with a slide plate key 136. As best illustrated in FIGS. 29-31, the slide plate key 136 has a non-circular shape, extends in a plane substantially perpendicular to a rotation axis 115 of the rotatable shaft 126, and is axially spaced from the casing 116. In the second exemplary embodiment of the present invention, the slide plate key 136 is non-movably attached (i.e., fixed) to the distal end of the rotatable shaft 126 after the inner plate 140 is fixed to the rotatable shaft 126.

As best illustrated in FIGS. 29-31, the outer plate 142 has an opening 148 therethrough complementary to an outer perimeter of the slide plate key 136. The outer plate 142 is rotatably mounted to the base unit 112. Specifically, the outer plate 142 is rotatably supported by an outer peripheral cylindrical surface of the rotatable shaft 126. As illustrated in FIGS. 24-25, in both the open and closed positions of the waste container 102, the outer plate 142 is oriented so that the opening 148 thereof are misaligned with the slide plate key 136. Consequently, in both the open and closed positions of the waste container 102, the outer plate 142 is non-removably mounted to the rotatable shaft 126 of the base unit 112, and cannot be removed from the rotatable shaft 126. Moreover, as best shown in FIGS. 30-31, the inner plate 140 and the outer plate 142 are disposed on the rotatable shaft 126 between the casing 116 and the slide plate key 136.

In the closed position of the pivotable unit 114 and the first blocking position of the rolling member 134 (shown in FIGS. 24 and 26), the rolling member 134 is engaged between the blocking member 128 and the casing 116. The locking device 110 is mounted to the waste container 102 so that when the waste container 102 is in its upright storage position on the ground, the rolling member 134 is maintained in the first blocking position, i.e. in a far left position, thereof (shown in FIG. 26) by gravity. Consequently, in the first blocking position thereof, the rolling member 134 is disposed between the blocking member 128 and a bottom wall of the casing 116. In this position, the rolling member 134 blocks (prevents) the pivoting movement of the pivoting unit 114 relative to the base unit 112. In other words, the rolling member 134 is in the first blocking position (shown in FIG. 26) and prevents the locking bar 6 from rotating relative to the waste container 102, thus maintaining the locking bar 6 in the closed position. However, by tilting the waste container 102 forwardly, the casing 116 becomes oriented generally horizontal and beyond, so that the rolling member 134 rolls by the force of gravity to the right as shown in FIGS. 27-28 within the cavity 117 away from the stop member 132 to the second release position thereof and no longer blocks the pivoting unit 114 from rotating relative to the base unit 112. Thus, in the second release position of the rolling member 134, the locking bar 6 can rotate relative to the waste container 102 from the closed position to the open position thereof, as illustrated in FIGS. 27 and 28.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A locking device for a container having a hinged lid, said locking device comprising:

a base unit adapted to be fixed to said container; and a pivotable unit mounted to said base unit and pivotally movable between an open position allowing opening of said hinged lid and a closed position preventing the opening of said hinged lid;

said base unit including a locking mechanism, said locking mechanism comprising a casing, a rotatable shaft extending through said casing, a blocking member non-movably secured to said rotatable shaft and disposed in said casing, a rolling member movably disposed within said casing, and a stop member;

said pivotable unit mounted to said rotatable shaft of said base unit;

said rolling member provided to move within said casing between a blocking position wherein said rolling member blocks rotational movement of said pivotable unit relative to said casing to prevent unauthorized opening of said hinged lid, and a release position wherein said rolling member moves away from said blocking member to permit the rotational movement of said blocking member relative to said casing thereby permitting the relative movement between said pivotable unit and said base unit to allow opening of said hinged lid, wherein said rolling member translates from the blocking position to the release position by gravity when the container is tilted at a predetermined angle;

said stop member configured to retain said rolling member in the blocking position when the container is not tilted at the predetermined angle.

2. The locking device according to claim 1, wherein said locking mechanism further comprises a slanted ramp disposed within said casing so as to be oriented at an oblique angle relative to a bottom wall of said casing in order to bias said rolling member to said blocking position thereof.

3. The locking device according to claim 2, wherein said slanted ramp extends between said bottom wall and a side wall of said casing so that a proximal end of said slanted ramp is fixed to said bottom wall of said casing and a distal end of said slanted ramp is fixed to said side wall of said casing.

4. The locking device according to claim 2, wherein said locking mechanism further comprises a stop member provided to retain said rolling member on said slanted ramp.

5. The locking device according to claim 1, wherein said pivotable unit comprises an inner plate non-movably attached to said rotatable shaft of said base unit and an outer plate rotatably mounted to said rotatable shaft so as to be pivotally movable relative to said inner plate.

6. The locking device according to claim 5, further comprising a lock device which locks said outer plate to said inner plate in order to prevent pivotal movement of said outer plate relative to said inner plate and to allow only an authorized person to unlock said outer plate.

7. The locking device according to claim 6, wherein each of said inner plate and said outer plate has an aperture therethrough and complementary to each other; and wherein said lock device locks said outer plate to said inner plate by engaging said apertures through said inner and outer plates.

8. The locking device according to claim 5, wherein said base unit further includes a slide plate key non-movably attached to a distal end of said rotatable shaft of said base unit.

9. The locking device according to claim 8, wherein said outer plate has an opening therethrough, including a substantially circular portion complementary to an outer perimeter of said side plate washer and a key portion complementary to a portion of an outer perimeter of said slide plate key such that in both of said open and closed positions said outer plate is oriented so that said key portion of said opening therein is misaligned with said slide plate key.

10. The locking device according to claim 9, wherein said outer plate is rotatably supported by an outer peripheral cylindrical surface of said rotatable shaft that engages said substantially circular portion of said opening of said outer plate.

11. The locking device according to claim 5, wherein a distal end of said outer plate has a mounting means to mount a locking bar that is positioned to extend over said hinged lid of said container.

12. The locking device according to claim 11, wherein said distal end of said outer plate is provided with a contact surface slanted relative to side edge surfaces of said outer plate, which extend between a proximal end and said distal end thereof.

13. A container moveable by a dumping vehicle between an upright position and a tilted position sufficient to enable at least some of the contents of said container to be dumped therefrom, said container comprising:

a container body;

at least one hinged lid pivotally mounted to said container body, said at least one hinged lid moveable between a closed position when said container is in the upright position and a open position when said container is in said tilted position; and a locking device comprising:

a base unit fixed to said container; and a pivotable unit mounted to said base unit and pivotally movable between an open position allowing opening of said hinged lid and a closed position preventing the opening of said hinged lid;

said base unit including a locking mechanism, said locking mechanism comprising a casing, a rotatable shaft extending through said casing, a blocking member non-movably secured to said rotatable shaft and disposed in said casing, a rolling member movably disposed within said casing, and a stop member;

said pivotable unit mounted to said rotatable shaft of said base unit;

said rolling member provided to move within said casing between a blocking position wherein said rolling member blocks rotational movement of said pivotable unit relative to said casing to prevent unauthorized opening of said hinged lid, and a release position wherein said rolling member moves away from said blocking member to permit the rotational movement of said blocking member relative to said casing thereby permitting the relative movement between said pivotable unit and said base unit to allow opening of said hinged lid, wherein said rolling member translates from the blocking position to the release position by gravity when said container is tilted at a predetermined angle;

the stop member configured to retain said rolling member in the blocking position when said container is in the upright position.

14. The container according to claim 13, wherein said container body is formed with a channel defined as a top rim of said container body; and wherein said base unit of said locking device is fixed to said channel on a side wall of said container body.

15. The container according to claim 13, wherein said base unit of said locking device is fixed to a side wall of said container body.

16. The container according to claim 13, wherein said base unit of said locking device includes a mounting plate fixed to said container body.

17. The container according to claim 13, wherein said locking mechanism further comprises a slanted ramp disposed within said casing so as to be oriented at an oblique angle relative to a bottom wall of said casing in order to bias said rolling member to the blocking position thereof.

18. The container according to claim 17, wherein said slanted ramp extends between said bottom wall and a side wall of said casing so that a proximal end of said slanted ramp is fixed to said bottom wall of said casing and a distal end of said slanted ramp is fixed to said side wall of said casing.

19. The container according to claim 18, wherein said locking mechanism further comprises a stop member provided to retain said rolling member on said slanted ramp.

20. The container according to claim 13, wherein said pivotable unit comprises an inner plate non-movably attached to said rotatable shaft of said base unit and an outer plate rotatably mounted to said rotatable shaft so as to be pivotally movable relative to said inner plate.

21. The container according to claim 20, further comprising a lock device which locks said outer plate to said inner plate in order to prevent pivotal movement of said outer plate relative to said inner plate and to allow only an authorized person to unlock said outer plate.

22. The container according to claim 21, wherein each of said inner plate and said outer plate has an aperture therethrough and complementary to each other; and wherein said lock device locks said outer plate to said inner plate by engaging said apertures through said inner and outer plates.

23. The container according to claim 20, wherein said base unit further includes a slide plate key non-movably attached to a distal end of said rotatable shaft of said base unit.

24. The container according to claim 23, wherein said outer plate has an opening therethrough, including a substantially circular portion complementary to an outer perimeter of said side plate washer and a key portion complementary to a portion of an outer perimeter of said slide plate key such that in both of said open and closed positions said outer plate is oriented so that said key portion of said opening therein is misaligned with said slide plate key.

25. The container according to claim 24, wherein said outer plate is rotatably supported by an outer peripheral cylindrical surface of said rotatable shaft that engages said substantially circular portion of said opening of said outer plate.

26. The container according to claim 20, wherein a distal end of said outer plate has a mounting means to mount a locking bar that is positioned to extend over said hinged lid of said container.

27. The container according to claim 26, wherein said distal end of said outer plate is provided with a contact surface slanted relative to side edge surfaces of said outer plate, which extend between a proximal end and said distal end thereof.

28. The container according to claim 27, wherein said container is provided with a trunnion bar; and wherein a side edge surface of said outer plate, which extends between a proximal end and said distal end thereof and faces said trunnion bar in an open position of said locking bar, includes a position bump oriented along said outer plate so as to engage said trunnion bar when said locking bar is in said open position thereof.

29. The locking device according to claim 1, wherein the casing comprises a bottom wall forming a ramp angled to bias the rolling member to the blocking position.

30. The locking device according to claim 1, wherein the casing is oriented at an oblique angle relative to the horizontal, when the locking device is mounted on the container in an upright position, so that a bottom wall of the casing forms a ramp to bias the rolling member to the blocking position.

31. The container according to claim 13, wherein the casing comprises a bottom wall forming a ramp to bias the rolling member to the blocking position when the container is in an upright position.

32. The container according to claim 13, wherein the casing is oriented at an oblique angle relative to the horizontal, when the container body is disposed in an upright position, so that a bottom wall of the casing forms a ramp to bias the rolling member to the blocking position.

* * * * *